US009883307B2

(12) United States Patent
Uhle et al.

(10) Patent No.: US 9,883,307 B2
(45) Date of Patent: Jan. 30, 2018

(54) METHOD AND APPARATUS FOR DECOMPOSING A STEREO RECORDING USING FREQUENCY-DOMAIN PROCESSING EMPLOYING A SPECTRAL WEIGHTS GENERATOR

(71) Applicant: Fraunhofer-Gesellschaft zur Foerderung der angewandten Forschung e.V., Munich (DE)

(72) Inventors: Christian Uhle, Nürnberg (DE); Stefan Finauer, Erlangen (DE); Patrick Gampp, Erlangen (DE); Oliver Hellmuth, Erlangen (DE); Peter Prokein, Erlangen (DE); Christian Stoecklmeier, Spardorf (DE)

(73) Assignee: FRAUNHOFER-GESELLSCHAFT ZUR FOERDERUNG DER ANGEWANDTEN FORSCHUNG E.V., Munich (DE)

( * ) Notice: Subject to any disclaimer, the term of this patent is extended or adjusted under 35 U.S.C. 154(b) by 15 days.

(21) Appl. No.: 14/146,127

(22) Filed: Jan. 2, 2014

(65) Prior Publication Data

US 2014/0119545 A1 May 1, 2014

Related U.S. Application Data

(63) Continuation of application No. PCT/EP2012/062932, filed on Jul. 3, 2012.
(Continued)

(30) Foreign Application Priority Data

Oct. 26, 2011 (EP) ..... 11186715

(51) Int. Cl.
*H04S 1/00* (2006.01)
*H04S 3/00* (2006.01)

(52) U.S. Cl.
CPC ..... *H04S 1/00* (2013.01); *H04S 1/002* (2013.01); *H04S 3/002* (2013.01)

(58) Field of Classification Search
None
See application file for complete search history.

(56) References Cited

U.S. PATENT DOCUMENTS 8,145,498 B2 * 3/2012 Herre ..... G10L 19/008 704/500
2008/0031462 A1 2/2008 Walsh
(Continued)

FOREIGN PATENT DOCUMENTS

JP 2010534012 A 10/2010
JP 2010-541350 A 12/2010
(Continued)

OTHER PUBLICATIONS

Uhle, C. et al, "*A Supervised Learning Approach to Ambience Extraction From Mono Recordings for Blind Upmixing*", Proceedings of the 11th Conference on Digital Audio Effects (DAFX-08), Espoo, Finland, Sep. 1, 2008, pp. 1-8, XP002513198.
(Continued)

*Primary Examiner* — Curtis Kuntz
*Assistant Examiner* — Kenny Truong
(74) *Attorney, Agent, or Firm* — Patterson Thuente Pedersen, P.A.

(57) ABSTRACT

An apparatus for generating a stereo side signal having a first side channel and a second side channel from a stereo input signal having a first input channel and a second input channel is provided. The apparatus has a modification information generator for generating modification information based on mid-side information. Furthermore, the apparatus has a signal manipulator being adapted to manipulate the first input channel based on the modification information to
(Continued)

obtain the first side channel and being adapted to manipulate the second input channel based on the modification information to obtain the second side channel. The modification information generator has a spectral weights generator for generating the modification information by generating a first spectral weighting factor based on a mono mid signal and on a mono side signal of the stereo input signal.

16 Claims, 24 Drawing Sheets

Related U.S. Application Data

(60) Provisional application No. 61/504,588, filed on Jul. 5, 2011.

(56) References Cited

U.S. PATENT DOCUMENTS

| | | | | |
|---|---|---|---|---|
| 2009/0080666 | A1* | 3/2009 | Uhle et al. | 381/17 |
| 2010/0030563 | A1 | 2/2010 | Uhle | |
| 2010/0296672 | A1 | 11/2010 | Vickers | |
| 2012/0076307 | A1* | 3/2012 | Den Brinker et al. | 381/17 |
| 2013/0121411 | A1* | 5/2013 | Robillard et al. | 375/240.12 |

FOREIGN PATENT DOCUMENTS

| | | | |
|---|---|---|---|
| WO | WO 2005/059899 | A1 | 6/2005 |
| WO | WO 2010/140105 | A2 | 12/2010 |

OTHER PUBLICATIONS

International Telecommunication Union, Recommendation ITU-R. BS.775-2, *Multichannel Stereophonic Sound System with and Without Accompanying Picture*, Jul. 2006, 13 pages.

Boll, Stephen F., *Suppression of Acoustic Noise in Speech Using Spectral Subtraction*, IEEE Trans. on Accoustics, Speech, and Signal Processing, vol. 27 No. 2, Apr. 1979, pp. 113-120.

Cappé, Oliver, *Elimination of the Musical Noise Phenomenon with the Ephraim-Malah Noise Suppressor*, IEEE Trans. on Speech and Audio Processing vol. 2, 1994, pp. 345-349.

Schmidt, Gerhard, *Single-Channel Noise Suppression Based on Spectral Weighting*, EURASIP Newsletter; ISSN 1687-1421, vol. 15, No. 1, Mar. 2004.

Berouti et al, *Enhancement of Speech Corrupted by Acoustic Noise* Proc. of the IEEE Int. Conf. on Acoustics, Speech, and Signal Processing, ICASSP, 1979, pp. 208-211.

Martin, Rainer, *Spectral Subtraction Based on Minimum Statistics*, Proc. of EUSIPCO, Institute for Communication Systems and Data Processing (IND), Aachen University of Technology, 1994, p. 1182-1185.

Ephraim et al, *Speech Enhancement Using a Minimum Mean-Square Error Short-Time Spectral Amplitude Estimator*, Proc. of the IEEE Int. Conf. on Acoustics, Speech, and Signal Processing, ICASSP 1984, p. 1109-1121.

George, E. Bryan, *Single-Sensor Speech Enhancement Using a Soft-Decision/Variable Attenuation Algorithm*, Proc. of the IEEE Int. Conf. on Acoustics, Speech, and Signal Processing, ICASSP 1995, p. 816-819.

Avendano et al, *A Frequency-Domain Approach to Multichannel Upmix*, Creative Advanced Technology Center, Scotts Valley, CA, J. Audio Eng. Soc. vol. 52, No. 7/8, Jul./Aug. 2004.

Faller, Christof, *Multiple-Loudspeaker Playback of Stereo Signas'* Audiovisual Communications Laboratory, J. Audio Eng. Soc., vol. 54, No. 11, Nov. 2006.

International Search Report, Application No. PCT/EP2012/062932, dated Oct. 15, 2012, 4 pages.

International Preliminary Report on Patentability, Application No. PCT/EP2012/062932 dated Sep. 17, 2013, 15 pages.

Korean Office Action, Application No. 10-2014-7000054, dated Sep. 30, 2015, 5 pages.

Decision to Grant, Russian Application No. 2014103797, dated Jul. 6, 2016, English translation included, 23 pages.

Japanese Office Action, Application No. 2014-51773, dated Mar. 9, 2015, 3 pages.

* cited by examiner

METHOD AND APPARATUS FOR DECOMPOSING A STEREO RECORDING USING FREQUENCY-DOMAIN PROCESSING EMPLOYING A SPECTRAL WEIGHTS GENERATOR

CROSS-REFERENCE TO RELATED APPLICATIONS

This application is a continuation of copending International Application No. PCT/EP2012/062932, filed Jul. 3, 2012, which is incorporated herein by reference in its entirety, and additionally claims priority to U.S. Provisional Application No. 61/504,588, filed Jul. 5, 2011, and to European Application No. 11186715.6, filed Oct. 26, 2011, which are also incorporated herein by reference in their entireties.

TECHNICAL FIELD

The present invention relates to audio processing and in particular to a method and an apparatus for decomposing a stereo recording using frequency-domain processing.

BACKGROUND

Audio processing has advanced in many ways. In particular, surround systems have become more and more important. However, most music recordings are still encoded and transmitted as a stereo signal and not as a multi-channel signal. As surround systems comprise a plurality of loudspeakers, e.g. four or five speakers, it has been subject of many studies which signals should be provided to the plurality of loudspeakers, when there are only two input signals available.

In this context, format conversion of stereo signals for playback using surround sound systems, i.e. upmixing, plays an important role. The term "m-to -n upmixing describes the conversion of an m-channel audio signal to an audio signal with n-channels, where n>m. Two concepts of upmixing are widely known: upmixing with additional information guiding the upmix process and unguided ("blind") upmixing without the use of any side information, which is focused on here.

In the literature, two different approaches for an upmix process are reported. These concepts are the direct/ambient approach and the "in-the-band"-approach. The core component of direct/ambience-based techniques is the extraction of an ambient signal which is fed into the rear channels of a multi-channel surround sound signal. Ambient sounds are those forming an impression of a (virtual) listening environment, including room reverberation, audience sounds (e.g. applause), environmental sounds (e.g. rain), artistically intended effect sounds (e.g. vinyl crackling) and background noise. The reproduction of ambience using the rear channels evokes an impression of envelopment (being "immersed in sound") by the listener. Additionally, the direct sound sources are distributed among the front channels according to their position in the stereo panorama.

The "In-the-band"-approach aims at positioning all sounds (direct sound as well as ambient sounds) around the listener using all available loudspeakers. The positions of the sound sources perceived when reproducing upmixed format is ideally a function of their perceived positions in the stereo input signal. This approach can be implemented using the proposed signal processing.

Various approaches to upmixing in the frequency-domain have been developed in the past [9, 10]. They attempt a decomposition of the input signal and to direct and ambient signal component and a decomposition based on the spatial positions of the sound sources. Ambient signal components are identified based on measures of inter-channel coherence between the left and right channel. Direction-based decomposition is achieved based on the similarity of the magnitudes of the spectral coefficients. The patent application US 2009/0080666 describes a method for extracting an ambient signal using spectral weighting.

US 2010/0030563 describes a method for extracting an ambient signal for the application of upmixing. The method uses spectral subtraction. The time-frequency domain representation is obtained from the difference of the time-frequency-domain representation of the input signal and a compressed version of it, advantageously computed using non-negative matrix factorization.

US 2010/0296672 describes a frequency-domain upmix method using a vector-based signal decomposition. The decomposition aims at the extraction of a centered channel in contrast to a direct/ambient-signal decomposition [13]. An output signal for the center channel is computed which contains all information which is common to the left and right input channel signals. The residual signal of input signals and the center channel signals are computed for the left and right output channel signals.

SUMMARY

According to an embodiment, an apparatus for generating a stereo side signal having a first side channel and a second side channel from a stereo input signal having a first input channel and a second input channel may have: a modification information generator for generating modification information, the modification information generator having a spectral weights generator for generating the modification information by generating a first spectral weighting factor based on a mono mid signal and on a mono side signal of the stereo input signal, and a signal manipulator being adapted to manipulate the first input channel based on the modification information to obtain the first side channel and being adapted to manipulate the second input channel based on the modification information to obtain the second side channel.

According to another embodiment, an upmixer may have: an apparatus for generating a stereo side signal having a first side channel and a second side channel as mentioned above, wherein the apparatus is adapted to generate the first side channel as a first upmixer channel, and wherein the apparatus is adapted to generate the first side channel as a first upmixer channel, a first mid channel generator for generating the first mid channel as a third upmixer channel based on a difference between the first stereo input channel and the first side channel, and a second mid channel generator for generating the second mid channel as a fourth upmixer channel based on a difference between the second stereo input channel and the second side channel.

According to another embodiment, an apparatus for generating a stereo mid signal having a first mid channel and a second mid channel from a stereo input signal having a first input channel and a second input channel may have: a modification information generator for generating modification information, the modification information generator having a spectral weights generator for generating the modification information by generating a first spectral weighting factor based on a mono mid signal and on a mono side signal of the stereo input signal, and a signal manipulator being adapted to manipulate the first input channel based on the modification information to obtain the first mid channel and being adapted to manipulate the second input channel based on the modification information to obtain the second mid channel.

According to another embodiment, a method for generating a stereo side signal having a first side channel and a second side channel from a stereo input signal having a first input channel and a second input channel may have the steps of: generating modification information by generating a first spectral weighting factor based on a mono mid signal and on a mono side signal of the stereo input signal, manipulating the first input channel based on the modification information to obtain the first side channel, and manipulating the second input channel based on the modification information to obtain the second side channel.

According to still another embodiment, a method for generating a stereo mid signal having a first mid channel and a second mid channel from a stereo input signal having a first input channel and a second input channel may have the steps of: generating modification information by generating a first spectral weighting factor based on a mono mid signal and on a mono side signal of the stereo input signal, manipulating the first input channel based on the modification information to obtain the first mid channel, and manipulating the second input channel based on the modification information to obtain the second mid channel.

Another embodiment may have a computer program for implementing the above methods, executed on a computer or processor.

An apparatus for generating a stereo side signal having a first side channel and a second side channel from a stereo input signal having a first input channel and a second input channel is provided. The apparatus comprises a modification information generator for generating modification information based on mid-side information. Furthermore, the apparatus comprises a signal manipulator being adapted to manipulate the first input channel based on the modification information to obtain the first side channel and being adapted to manipulate the second input channel based on the modification information to obtain the second side channel.

The manipulation information generator may comprise a spectral subtractor for generating the modification information by generating a difference value indicating a difference between a mono mid signal or a mono side signal and the first or the second input channel. Or, the modification information generator may comprise a spectral weights generator for generating the modification information by generating a first spectral weighting factor based on a mono mid signal and on a mono side signal of the stereo input signal.

Mid-side information may be a mono mid signal of the stereo input signal, a mono side signal of the stereo input signal and/or a relation between the mono mid signal and the mono side signal of the stereo input signal. In an embodiment, the modification information generator is adapted to generate the modification information based on a mono mid signal of the stereo input signal or on a mono side signal of the stereo input signal as mid-side information.

According to an embodiment, a stereo recording is decomposed into a side and a mid signal, which, in contrast to conventional mid-side (M-S) decomposition, both are stereo signals. A signal separation may be applied using phase cancellation as in conventional M-S processing in combination with frequency-domain processing, namely spectral subtraction or spectral weighting. The derived signals may be applied for the reproduction of audio signals with additional playback channels.

An apparatus according to an embodiment decomposes a 2-channel stereo recording into a stereo side signal and a stereo mid signal. The stereo side signal has two main characteristics. First, it comprises all signal components except those which are panned to the center. In this respect, it is similar to the side signal which is known from mid-side processing of stereo signals. In fact, it comprises the same signal components as the side signal derived by conventional M-S decomposition.

The important difference between the proposed stereo side signal compared to the conventional side signal is described by the stereo property: the stereo side signal is a 2-channel stereo signal, in contrast to the conventional side signal, which is mono. The left channel of the stereo side signal comprises all signal components, which were panned to the left side in the input signal. The right channel of the stereo signal comprises all signal components which were panned to the right side.

The stereo mid signal is a stereo signal which comprises all components which exist in both input channels. It is a 2-channel stereo signal and comprises less stereo information compared to the input signal and compared to the stereo side signal, but it is not a monophonic signal like the conventional mid signal. It comprises the same signal components as the conventional mid signal but with the original stereo information.

According to an embodiment, the modification information generator comprises a spectral subtractor. The spectral subtractor may be adapted to generate the modification information by subtracting a magnitude value or a weighted magnitude value of the first or the second input channel from a magnitude value or a weighted magnitude value of the mono mid signal or the mono side signal of the stereo input signal. Or, the spectral subtractor may be adapted to generate the modification information by subtracting a magnitude value or a weighted magnitude value of the mono mid signal or the mono side signal of the stereo input signal from a magnitude value or a weighted magnitude value of the first or the second input channel.

Furthermore, the modification information generator may comprise a magnitude determinator. The magnitude determinator may be adapted to receive at least one of the first input channel, the second input channel, the mono mid signal or the mono side signal, being represented in a spectral domain, as received magnitude input signal. Moreover, the magnitude determinator may be adapted to determine at least one magnitude value of each received magnitude input signal, and may be adapted to feed the at least one magnitude value of each received magnitude input signal into the spectral subtractor.

In an embodiment, the spectral subtractor comprises a first spectral subtraction unit and a second spectral subtraction unit, wherein the magnitude determinator is arranged to receive the first and the second input channel and the mono mid signal, wherein the magnitude determinator is adapted to determine a first magnitude value of the first input channel, a second magnitude value of the second input channel and a third magnitude value of the mono mid signal, wherein the magnitude determinator is adapted to feed the first, the second and the third magnitude value into the spectral subtractor. The first spectral subtraction unit may be adapted to conduct a first spectral subtraction based on the first magnitude value of the first input channel and the third magnitude value of the mono mid signal to obtain a first stereo side magnitude value of the first stereo side signal, and wherein the second spectral subtraction unit is adapted to conduct a second spectral subtraction based on the second magnitude value of the second input channel and the third magnitude value of the mono mid signal to obtain a second stereo side magnitude value of the second stereo side signal.

The first spectral subtraction unit may be adapted to conduct the first spectral subtraction by applying the formula:

$$\hat{S}_l(f)=|X_1(f)|-w|M_1(f)|$$

wherein $\hat{S}_l(f)$ indicates a first stereo side magnitude spectrum when the result of the spectral subtraction is positive, wherein $|X_1(f)|$ indicates a first magnitude spectrum of the first input channel, wherein $|M_1(f)|$ indicates a third magnitude spectrum of the mono mid signal and wherein w indicates a scalar factor in the range $0 \le w \le 1$. The second spectral subtraction unit may be adapted to conduct the second spectral subtraction by applying the formula:

$$\hat{S}_r(f)=|X_r(f)-w|M_1(f)|$$

wherein $\hat{S}_r(f)$ indicates second stereo side magnitude spectrum when the result of the spectral subtraction is positive, wherein $|X_r(f)|$ indicates the second magnitude spectrum of the first input channel, wherein $|M_1(f)|$ indicates the third magnitude spectrum of the mono mid signal and wherein w indicates a scalar factor in the range $0 \le w \le 1$.

In an embodiment, the signal manipulator may comprise a phase extractor and a combiner. The phase extractor may be arranged to receive the first input channel and the second input channel, wherein the phase extractor is adapted to determine a first phase value of the first input channel as a first stereo side phase value and a second phase value of the second input channel as a second stereo side phase value. The phase extractor may be adapted to feed the first stereo side phase value and the second stereo side phase value into the combiner, wherein the first spectral subtraction unit is adapted to feed the first stereo side magnitude value into the combiner, wherein the second spectral subtraction unit is adapted to feed the second stereo side phase value into the combiner. The combiner may be adapted to combine the first stereo side magnitude value and the first stereo side phase value to obtain a first complex coefficient of a first spectrum of the first side channel. Furthermore, the combiner may be adapted to combine the second stereo side magnitude value and the second stereo side phase value to obtain a second complex coefficient of a second spectrum of the second side channel.

According to an embodiment, the modification information generator comprises a spectral weights generator for generating the modification information by generating a first spectral weighting factor, wherein the first spectral weighting factor depends on the mono mid signal and the mono side signal of the stereo input signal.

The modification information generator may further comprise a magnitude determinator. The magnitude determinator may be adapted to receive the mono mid signal being represented in a spectral domain. The magnitude determinator may be adapted to receive the mono side signal being represented in a spectral domain, wherein the magnitude determinator is adapted to determine a magnitude value of the mono side signal as a magnitude side value and wherein the magnitude determinator is adapted to determine a magnitude value of the mono mid signal as a magnitude mid value. The magnitude determinator may be adapted to feed the magnitude side value and the magnitude mid value into the spectral weights generator. The spectral weights generator may be adapted to generate the first spectral weighting factor based on a ratio of a first number to a second number, wherein the first number depends on the magnitude side value, and wherein the second number depends on the magnitude mid value and the magnitude side value.

In a further embodiment, the spectral weights generator is adapted to generate the modification factor according to the formula $$G_s(f)=\left(\frac{|S(f)|^\alpha}{\delta|S(f)|^\alpha+\gamma|M(f)|^\alpha}\right)^{\frac{1}{\beta}}$$

wherein $|S(f)|$ indicates a magnitude value of the mono side signal, wherein $|M(f)|$ indicates a magnitude value of the mono mid signal and wherein $\alpha$, $\beta$, $\gamma$ and $\delta$ are scalar factors. In an embodiment, $\alpha$ and $\beta$ are greater than 0 ($\alpha>0$; $\beta>0$); and $\gamma$ and $\delta$ are selected such that $0 \le \gamma \le 1$ and $0 \le \delta \le 1$. Advantageously, $4 \ge \alpha > 0$ and $4 \ge \beta > 0$.

Furthermore, the spectral weights generator may be adapted to generate the modification factor according to the formula:

$$G_s(f)=\left(\frac{|S(f)|^\alpha}{\delta|S(f)|^\alpha+\gamma\min[|X_l(f)|,|X_r(f)|]^\alpha}\right)^{\frac{1}{\beta}}$$

or, wherein the spectral weights generator is adapted to generate the modification factor according to the formula:

$$G_s(f)=\left(\frac{|S(f)|^\alpha}{\delta|S(f)|^\alpha+\gamma Q(f)^\alpha}\right)^{\frac{1}{\beta}}$$

with $$Q(f)=\eta\min[|X_1(f)|,|X_r(f)|]+(1-\eta)M(f)$$

wherein $|S(f)|$ indicates a magnitude spectrum of the mono side signal, wherein $|M(f)|$ indicates a magnitude spectrum of the mono side signal, wherein $|X_1(f)|$ indicates a magnitude spectrum of the first input channel, wherein $|X_r(f)|$ indicates a magnitude spectrum of the first input channel, wherein M(f) indicates the mono mid signal, and wherein $\alpha$, $\beta$, $\gamma$, $\delta$ and $\eta$ are scalar factors.

According to an embodiment, the modification information generator is adapted to generate the modification information based on the mono mid signal of the stereo input signal or on the mono side signal of the stereo input signal as mid-side information. The mono mid signal may depend on a sum signal resulting from adding the first and the second input channel. The mono side signal may depend on a difference signal resulting from subtracting the second input channel from the first input channel.

Moreover, the apparatus may further comprise a channel generator, wherein the channel generator is adapted to generate the mono mid signal or the mono side signal based on the first and the second input channel.

Furthermore, the apparatus may further comprise a transform unit for transforming the first and the second input channel of the stereo input signal from a time domain into a spectral domain, and an inverse transform unit. The signal manipulator may be adapted to manipulate the first input channel being represented in the spectral domain and the second input channel being represented in the spectral domain to obtain the stereo side signal being represented in the spectral domain. The inverse transform unit may be adapted to transform the stereo side signal being represented in the spectral domain from the spectral domain into the time domain.

In an embodiment, the apparatus may be adapted to generate a stereo mid signal having a first mid channel and a second mid channel. The first mid channel may be generated based on a difference between the first stereo input channel and the first side channel. The second mid channel may be generated based on a difference between the second stereo input channel and the second side channel.

According to another embodiment, an apparatus for generating a stereo mid signal having a first mid channel and a second mid channel from a stereo input signal having a first input channel and a second input channel is provided. The apparatus comprises a modification information generator for generating modification information based on mid-side information, and a signal manipulator being adapted to manipulate the first input channel based on the modification information to obtain the first mid channel and being adapted to manipulate the second input channel based on the modification information to obtain the second mid channel.

According to an embodiment, the modification information generator may comprise a spectral weights generator for generating the modification information by generating a first spectral weighting factor. The first spectral weighting factor may depend on a mono mid signal and a mono side signal of the stereo input signal. The modification information generator may further comprise a magnitude determinator, wherein the magnitude determinator is adapted to determine a magnitude value of the mono side signal being represented in a spectral domain as a magnitude side value, and wherein the magnitude determinator is adapted to determine a magnitude value of the mono mid signal being represented in a spectral domain as a magnitude mid value. The magnitude determinator may be adapted to feed the magnitude side value and the magnitude mid value into the spectral weights generator. The spectral weights generator may be adapted to generate the first spectral weighting factor based on a ratio of a first number to a second number, wherein the first number depends on the magnitude side value, and wherein the second number depends on the magnitude mid value and the magnitude side value.

The spectral weights generator may be adapted to generate the modification factor according to the formula $$G_m(f) = \left(\frac{|M(f)|^\alpha}{\gamma|S(f)|^\alpha + \delta|M(f)|^\alpha}\right)^{\frac{1}{\beta}}$$

wherein |M(f)| indicates a magnitude spectrum of the mono mid signal, wherein |S(f)| indicates a magnitude spectrum of the mono side signal and wherein $\alpha$, $\beta$, $\gamma$ and $\delta$ are scalar factors. In an embodiment, $\alpha$ and $\beta$ are greater than 0 ($\alpha>0$; $\beta>0$); and $\gamma$ and $\delta$ are selected such that $0\leq\gamma\leq1$ and $0\leq\delta\leq1$. Advantageously, $4\geq\alpha>0$ and $4\geq\beta>0$.

BRIEF DESCRIPTION OF THE DRAWINGS

Embodiments of the present invention are explained with reference to the accompanying drawings in which.

DETAILED DESCRIPTION

Before describing embodiments of the present invention, related concepts will be described, in particular M-S processing, the fundamentals of a spectral subtraction and spectral weighting will be explained.

At first, Mid-Side Processing is described in more detail. To explain, how the stereo side and mid signals are computed, the basics of conventional M-S processing are briefly reviewed. A 2-channel stereo signal x(t) can be represented by two signals $x_1(t)$ and $x_r(t)$ for the left and right channel, respectively, with a time index t. The terms left and right indicate that eventually these signals are presented to the left and right ear (using loudspeakers or headphones), respectively, or reproduced by the left and right channel in an audio reproduction system, respectively.

Assuming that the stereo signal is a mixture of N source signals $z_i$, i=1, . . . , N, $x_1(t)$ and $x_r(t)$ can be written as $$x_l(t) = \sum_{i=1}^{N} h_{li}(t) * z_i(t) + n_l(t) \tag{1}$$

$$x_r(t) = \sum_{i=1}^{N} h_{ri}(t) * z_i(t) + n_r(t) \tag{2}$$

where $h_{li}(t)$, $h_{ri}(t)$ are transfer functions characterizing how the sources are mixed into the stereo signal, * is the convolution operation, and $n_1(t)$, $n_r(t)$ are uncorrelated ambient signals. In case of mixing using only amplitude panning, which is often the case for studio recordings, both $h_{li}(t)$ and $h_{ri}(t)$ are scalars. The output of this mixing process is in the literature known as instantaneous mixtures in contrast to convoluted mixtures (in cases where $h_{li}(t)$ and $h_{ri}(t)$ are of length larger than one). Discarding the ambient terms $n_1(t)$, $n_r(t)$, the signal model for instantaneous mixing can be written as $$x_l(t) = \sum_{i=1}^{N} (1 - a_i(t))y_i(t) \tag{3}$$

$$x_r(t) = \sum_{i=1}^{N} a_i(t)y_i(t) \tag{4}$$

with mixing factor $0 \le a_i(t) \le 1$ determining the perceived direction of the source signals and the mixture.

The same information as comprised in the signal $x(t)=[x_l(t)\ x_r(t)]$ is provided when using an M-S representation of the signal, where a mid signal $m_1(t)$ (also referred to as sum signal) and a side signal $s_1(t)$ (also referred to as difference signal) are computed from $x_l(t)$ and $x_r(t)$ according to:

$$m_1(t) = \frac{1}{2}(x_l(t) + x_r(t)) \tag{5}$$

$$s_1(t) = \frac{1}{2}(x_l(t) - x_r(t)) \tag{6}$$

The subscripts 1 are used to designate that these signals are monophonic. Such M-S signal is advantageous for various applications where both side and mid signal are processed, coded or transmitted separately. Such applications are sound recording, artificial stereophonic image enhancement, audio coding for virtual loudspeaker production, binaural reproduction over loudspeakers and quadraphonic production.

Given the M-S representation, the signals $x_l(t)$ and $x_r(t)$ can be computed according to:

$$x_1(t)=m_1(t)+s_1(t) \tag{7}$$

$$x_r(t)=m_1(t)-s_1(t) \tag{8}$$

Figure 18:
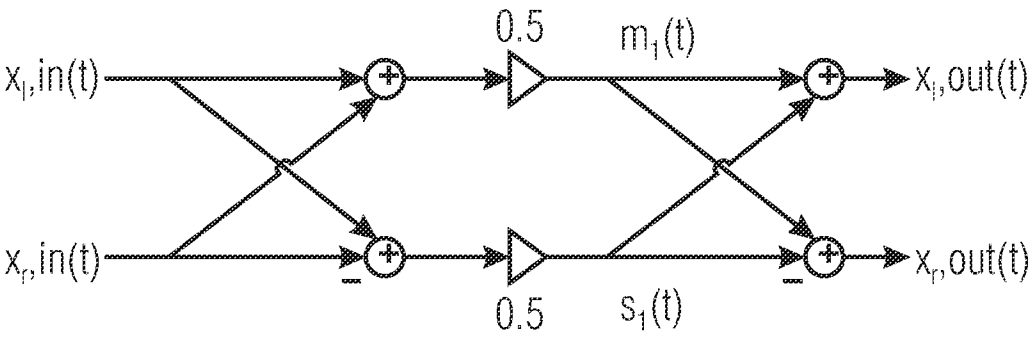
FIG. 18 depicts a block diagram of M-S decomposition.

In FIG. 18, the M-S decomposition is illustrated.

Both representations comprise the same information. It is noted that the normalizing weights 0.5 in equations (5) and (6) are optional and other weights are possible, but the weight shown here guarantees that applying equations (5) to (8) yield signals which are identical to the input signals. Using other weights may yield similar or scaled signals.

From the signal model and equations (3) and (4) follows that the signal $s_1(t)$ comprises only signal components which are panned off-center (some of them with negative phase) and is a mono signal. The mid signal $m_1(t)$ comprises all signals except those in $s_1(t)$. Described with the words of Michael Gerzon, "M is the signal containing information about the middle of the stereo stage, whereas S only contains information about the sides". Both are monophonic signals. While amplitude panned direct sounds are attenuated in the side signal depending on their position in the stereo panorama, the uncorrelated signal components like reverberation and other ambient signals are attenuated in the mid signal by 3 dB (for zero correlation). These attenuations are caused by the phase cancellation between the side components in the left and right channel.

In the following, spectral subtraction and spectral weighting is explained in more detail.

Spectral subtraction is a well-known method for speech enhancement and noise reduction. It has been (presumably originally) proposed by Boll for reducing the effects of additive noise in speech communication [2]. The processing is performed in the frequency-domain, where the spectra of short frames of successive (possibly overlapping) portions of the input signal are processed.

The basic principle is to subtract an estimate of the magnitude spectrum of the interfering noise signal from the magnitude spectra of the input signals, which is assumed to be a mixture of a desired speech signal and an interfering noise signal.

Spectral weighting (or Short-Term Spectral Attenuation [3]) is commonly used in various applications of audio signal processing, e.g. Speech Enhancement [4] and Blind Source Separation. As in spectral subtraction, the aim of this processing is to separate a desired signal d(t) or to attenuate an interfering signal n(t) where the input signal x(t) is an additive mixture of d(t) and n(t), $$x(t)=d(t)+n(t) \tag{9}$$

Figure 19:
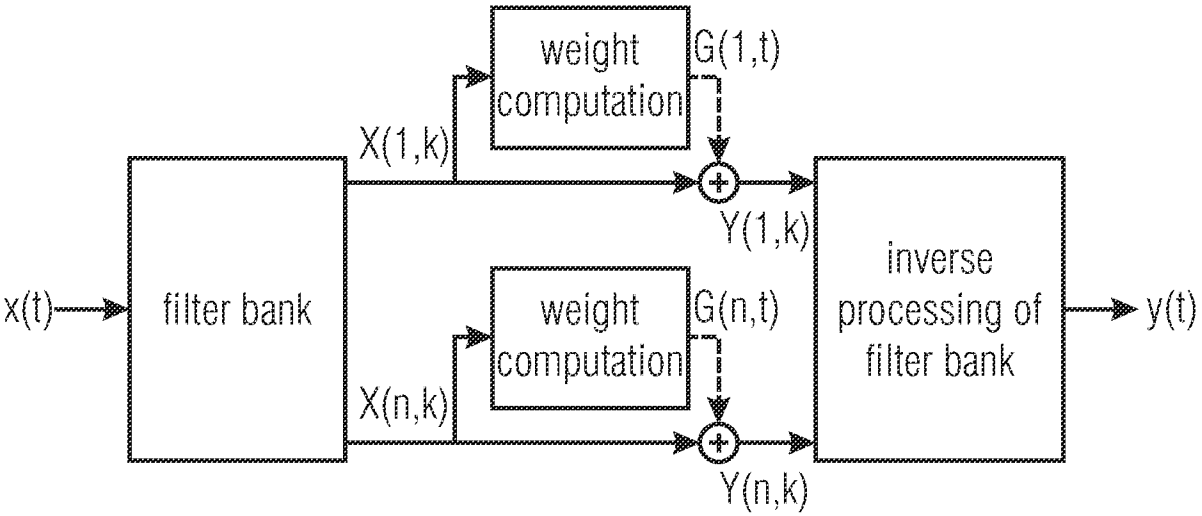
FIG. 19 depicts a block diagram illustrating spectral weighting.

This processing is illustrated in FIG. 19. The signal processing is performed in the frequency domain. Therefore, the input signal x(t) is transformed using a Short-Time Fourier Transform (STFT), a filter bank or any other means for deriving a signal representation with multiple frequency bands X(f, k), with frequency band index f and time index k. The frequency-domain representation of the input signals are processed such that the sub-band signals are scaled with time-variant weights G(f, k), $$Y(f,k)=G(f,k)X(f,k) \tag{10}$$

The weights are computed from the input signal representation X(f, k) such that they have large magnitudes for high signal-to-noise ratios (SNR), and low values for small SNRs. For computing the weights G(f, k), and estimate of the typically time- and frequency dependent SNR, or of N(f, k) or S(f, k) is necessitated. In speech processing applications, the estimate of the noise is calculated during non-speech activity [2, 5], or using minimum statistics [6], i.e. based on the tracking of local minima in each sub-band, or by using a second microphone near the noise source.

The result of the weighting operation Y(f, k) is the frequency-domain representation of the output signal. The output time signal y(t) is computed using the inverse processing of the frequency-domain transform, e.g. the Inverse STFT.

Often, the weights G(f, k) are chosen to be real-valued, yielding output spectra Y having the same phase information as X. Various gaining rules, e.g. how the weights G(f, k) are computed, exist, e.g. derived from spectral subtraction and Wiener filtering. In the following, different methods for deriving the spectral weights will be described. It is assumed that s and n are mutually orthogonal, i.e.

$$E\{x_k^2\}=E\{d_k^2\}+E\{n_k^2\} \tag{11}$$

In the following, Wiener filtering is explained in more detail. Given estimates of the power spectral densities (PSD) (e.g. derived from the STFT coefficients) of the desired signal $P_{dd}$ and the interfering signal $P_{nn}$, the spectral weights are derived by minimizing the mean squared error $$E\{(d(t)-y(t))^2\} \tag{11a}$$

$$G_{wf}(f)=\frac{P_{ss}}{P_{xx}}=\frac{P_{dd}}{P_{dd}+P_{nn}} \tag{12}$$

Spectral subtraction using spectral weighting is now explained.

The spectral weights are computed such that $P_{yy}=P_{xx}-P_{nn}$, i.e.

$$G_{ssp}(f)=\sqrt{\frac{P_{dd}}{P_{dd}+P_{nn}}} \tag{13}$$

Alternatively, real-valued spectral weights can be derived which lead to |Y|=|X|−|N|, often referred to as spectral magnitude subtraction, with weights $$G_{ssyn}(f)=\frac{|D|}{|D|+|N|} \tag{14}$$

|D| is the magnitude spectrum of d(t). |N| is the magnitude spectrum of n(t). The generalization of the spectral weighting rule is now explained. The generalized formulation of the STSA filter is derived by introducing three parameters α, β and γ, where α and β are exponents controlling the strength of attenuation and γ is the noise overestimation factor.

$$G_g(f)=\left(\frac{|D(f)|^\alpha}{|D(f)|^\alpha+\gamma|N(f)|^\alpha}\right)^{\frac{1}{\beta}} \tag{15}$$

Equation (15) is a generalized formulation of the noise suppression rules described above, where α=2, β=2 corresponds to spectral subtraction and α=2, β=1 corresponds to Wiener filtering. Spectral substraction of the magnitude (instead of energies) is realized by setting α=1, β=1. The parameter γ controls the amount of noise and accounts for possible biases of a noise estimation method. It can be chosen to relate to the estimated SNR or the frequency index.

Figure 20:
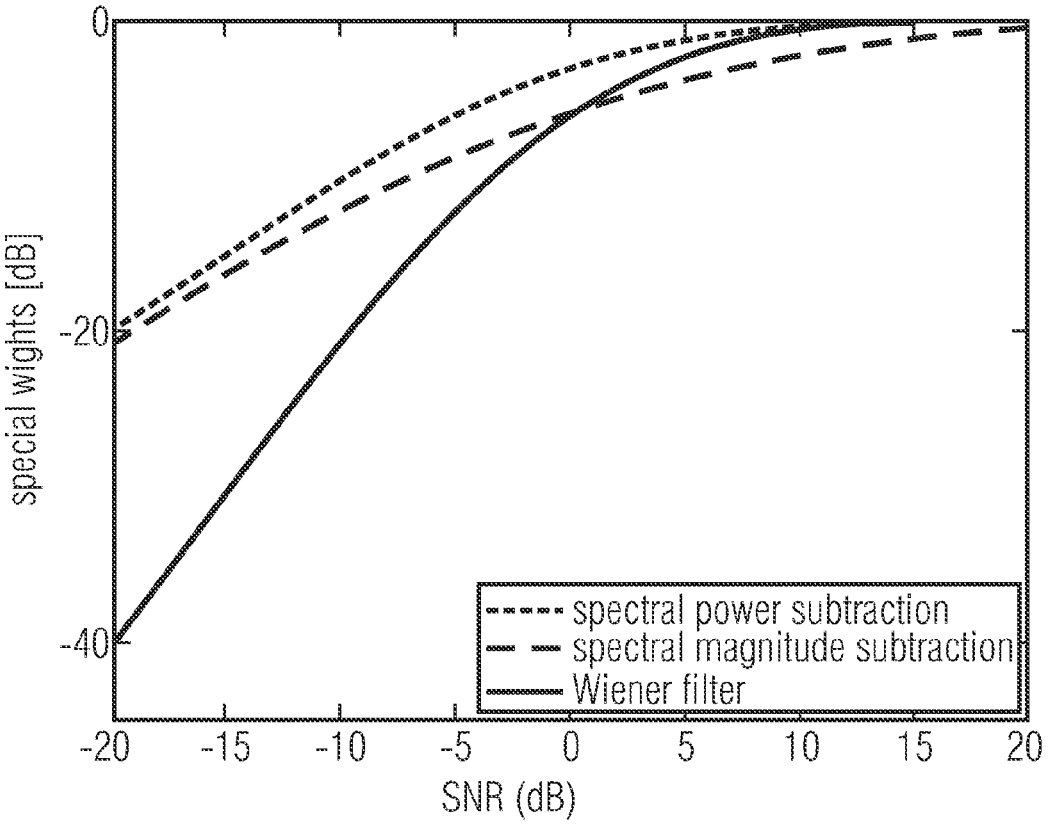
FIG. 20 illustrates typical spectral weights as used in speech enhancement.

In FIG. 20, typical spectral weights are illustrated as a function of the SNR, as used in speech enhancement.

A variety of other gaining rules can be found, with the common characteristics that the weights are monotonically increasing with the sub-band SNR, e.g. the Ephraim-Malah estimator [7] or the Soft-Decision/Variable Attenuation algorithm (SDVA) [8].

In practical implementations, the spectral weights are typically bound by a minimum value larger than zero in order to reduce artifacts. Different gaining rules can be applied in different frequency ranges [4]. The resulting gains can be smoothed along both the time axis and the frequency axis in order to reduce artifacts. Typically, a first order low-pass filter (leaky integrator) is used for the smoothing along the time axis and a zero phase low-pass filter is applied along the frequency axis.

Figure 1:
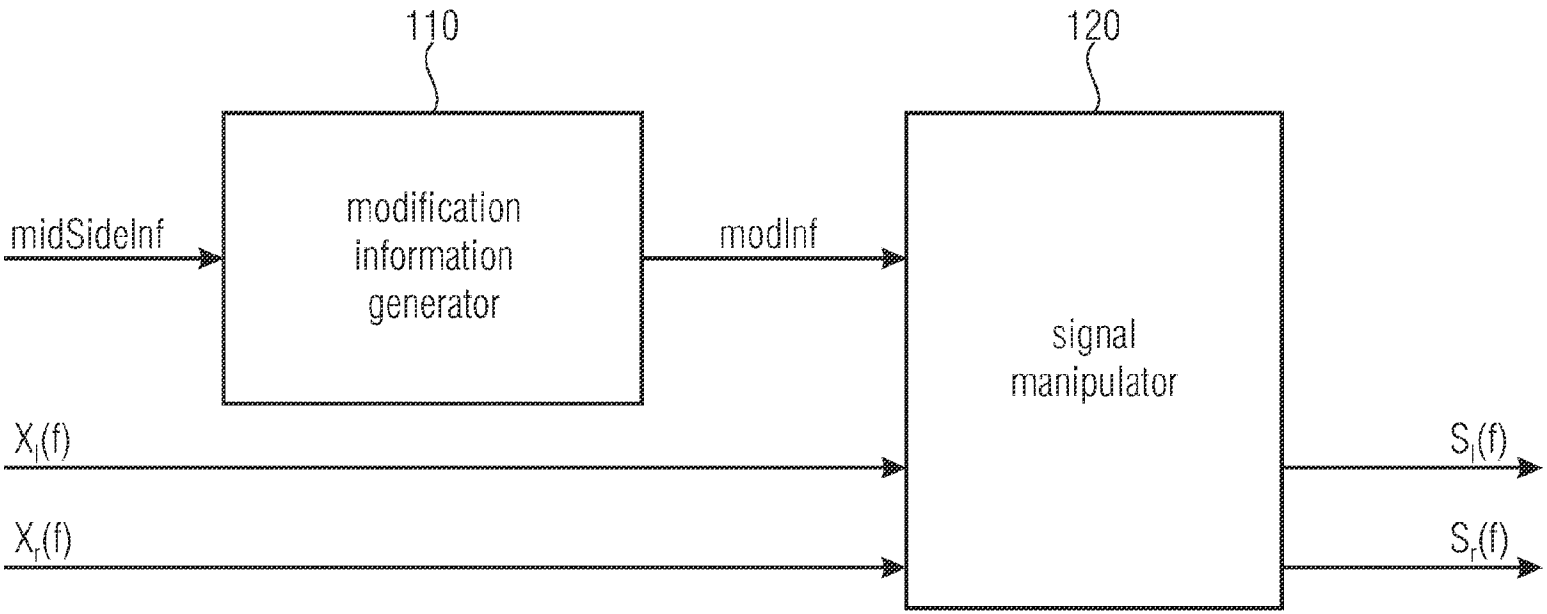
FIG. 1 illustrates an apparatus for generating a stereo side signal according to an embodiment.

Embodiments:

FIG. 1 illustrates an apparatus for generating a stereo side signal having a first side channel $S_l(f)$ and a second side channel $S_r(f)$ from a stereo input signal having a first input channel $X_l(f)$ and a second input channel $X_r(f)$ according to an embodiment. The apparatus comprises a modification information generator 110 for generating modification information modInf based on mid-side information midSideInf. Furthermore, the apparatus comprises a signal manipulator 120 being adapted to manipulate the first input channel $X_l(f)$ based on the modification information modInf to obtain the first side channel $S_l(f)$ and being adapted to manipulate the second input channel $X_r(f)$ based on the modification information modInf to obtain the second side channel $S_r(f)$.

For example, the modification information generator 110 may be adapted to generate the modification information modInf based on mid-side information midSideInf that is related to a mono mid signal of a stereo input signal, a mono side signal of the stereo input signal and/or a relation between the mono mid signal and the mono side signal of a stereo input signal.

The mono mide signal may depend on a sum signal resulting from adding the first and the second input channel $X_l(f)$, $X_r(f)$. The mono side signal may depend on a difference signal resulting from subtracting the second input channel from the first input channel. For example, the mono mid signal may be calculated according to the formula:

$$M_1(f)=\tfrac{1}{2}(X_l(f)+X_r(f)) \tag{15a}$$

The mono side signal may, for example, be calculated according to the formula:

$$S_1(f)=\tfrac{1}{2}(X_l(f)-X_r(f)) \tag{15b}$$

Figure 1A:
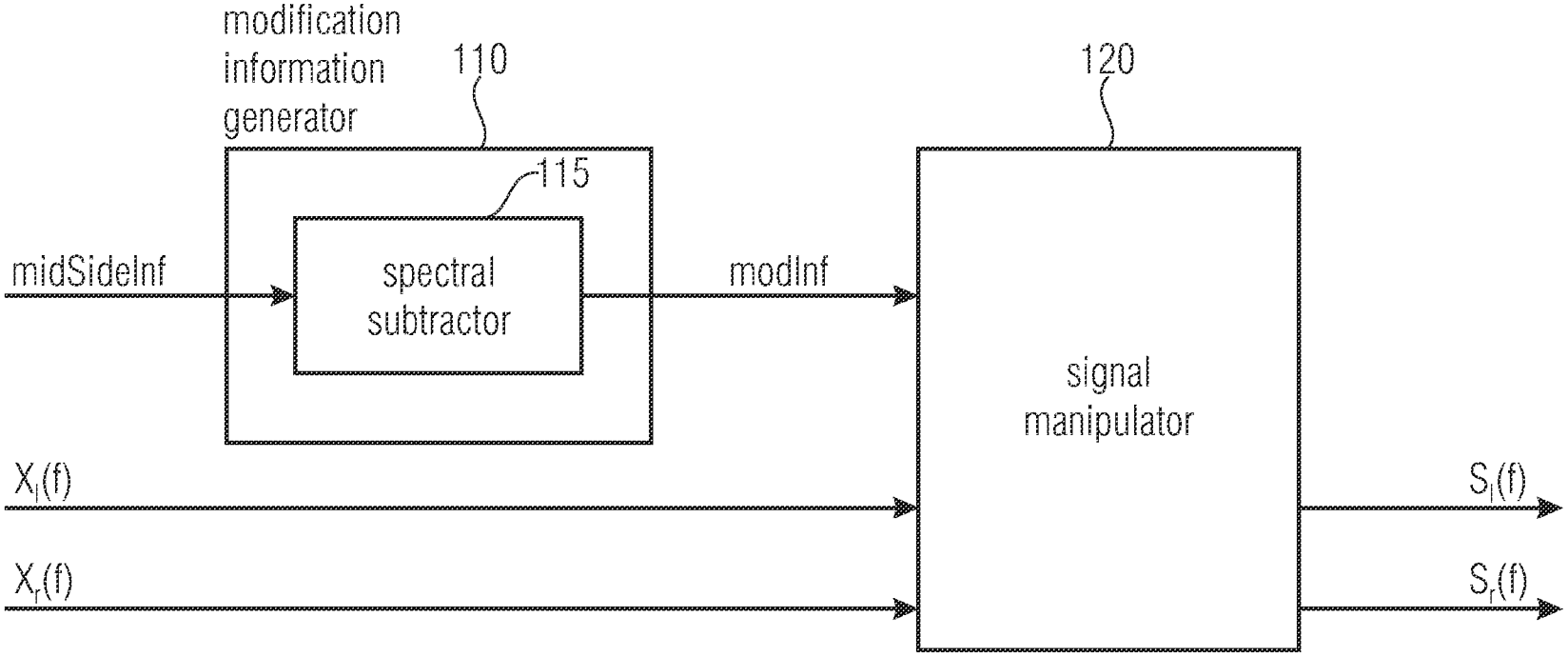
FIG. 1*a* illustrates an apparatus for generating a stereo side signal according to an embodiment, wherein the manipulation information generator comprises a spectral subtractor.

FIG. 1*a* illustrates an apparatus for generating a stereo side signal according to an embodiment, wherein the manipulation information generator 110 comprises a spectral subtractor 115. The spectral subtractor 115 is adapted to generate the modification information modInf by generating a difference value indicating a difference between a mono mid signal or a mono side signal of the stereo input signal and the first or the second input channel. For example, the spectral subtractor 115 may be adapted to generate the modification information modInf by subtracting a magnitude value or a weighted magnitude value of the first or the second input channel from a magnitude value or a weighted magnitude value of the mono mid signal or the mono side signal of the stereo input signal. Or, the spectral subtractor 115 may be adapted to generate the modification information modInf by subtracting a magnitude value or a weighted magnitude value of the mono mid signal or the mono side signal of the stereo input signal from a magnitude value or a weighted magnitude value of the first or the second input channel.

Figure 1B:
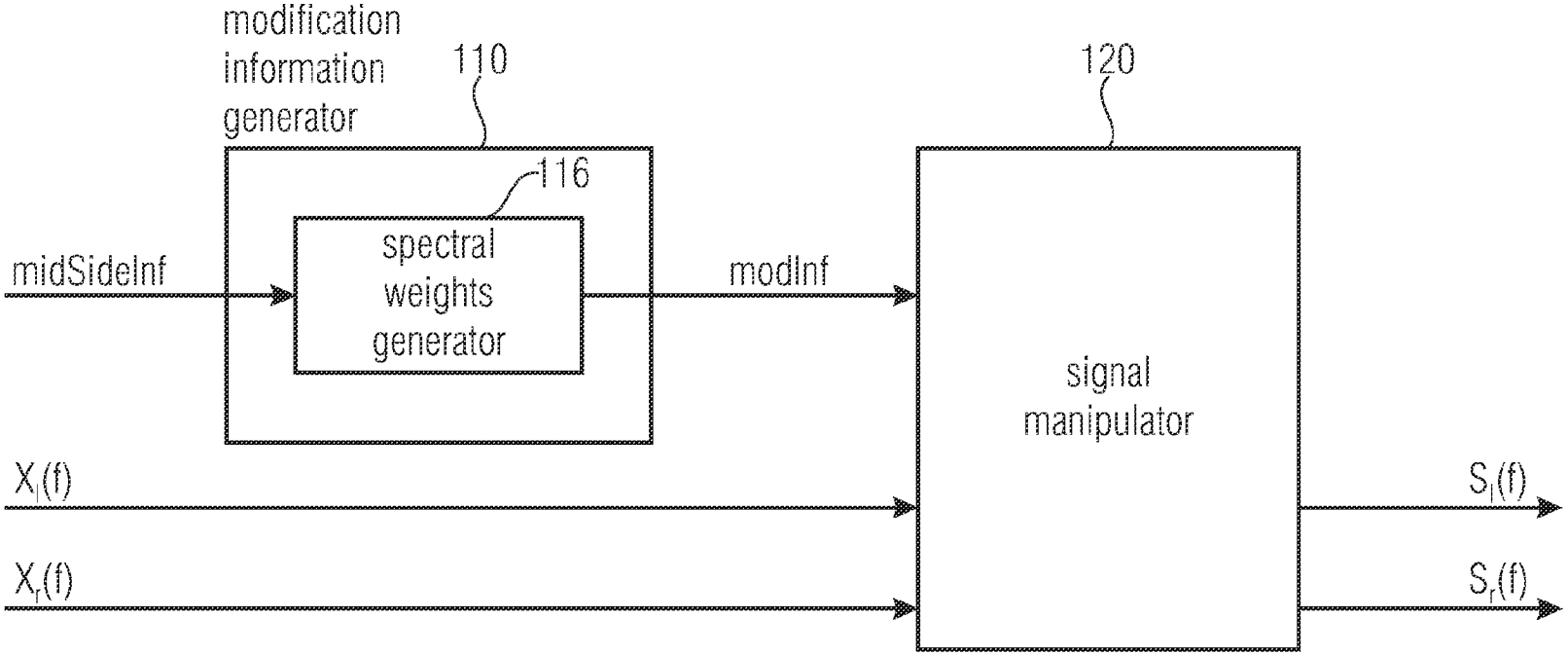
FIG. 1*b* illustrates an apparatus for generating a stereo side signal according to an embodiment, wherein the modification information generator comprises a spectral weights generator.

FIG. 1*b* illustrates an apparatus for generating a stereo side signal according to an embodiment, wherein the modification information generator 110 comprises a spectral weights generator 116 for generating the modification information modInf by generating a first spectral weighting factor based on a mono mid signal and on a mono side signal of the stereo input signal.

Figure 2:
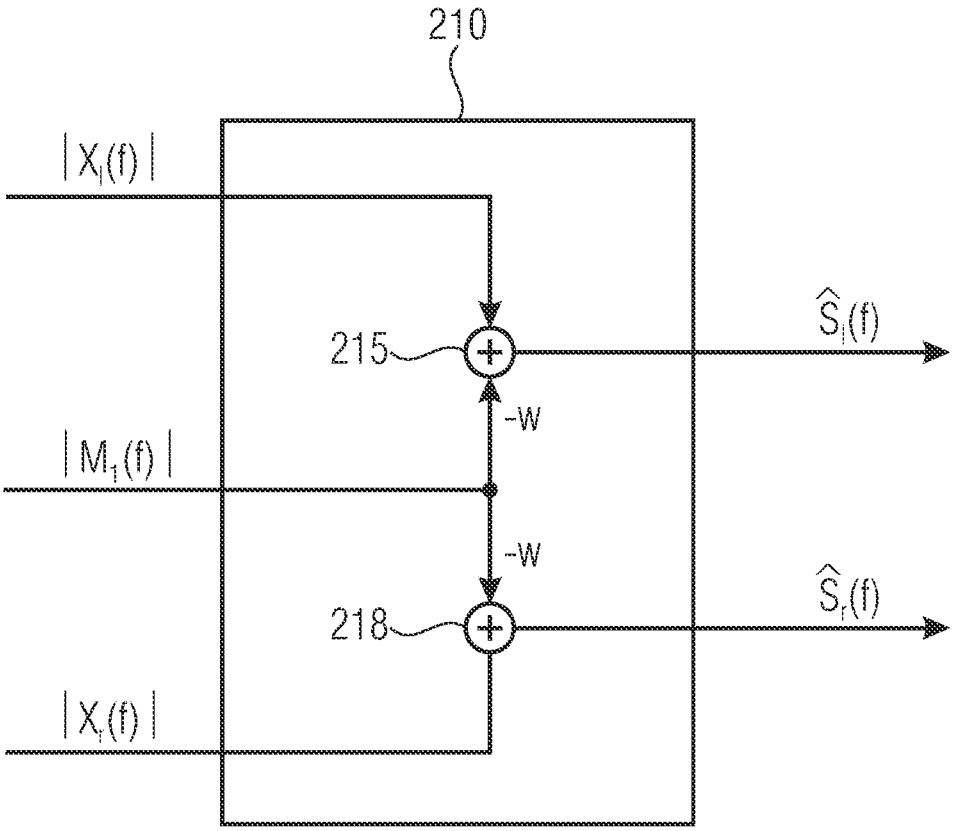
FIG. 2 illustrates a spectral subtractor according to an embodiment.

FIG. 2 illustrates a spectral subtractor 210 according to an embodiment. A first magnitude spectrum $|X_1(f)|$ of the first input channel, a second magnitude spectrum $|X_r(f)|$ of the second input channel and a third magnitude spectrum $|M_1(f)|$ of a mono mid signal of the stereo input signal is fed into the spectral subtractor 210.

A first spectral subtraction unit 215 of the spectral subtractor 210 subtracts the third spectrum $|M_1(f)|$ being weighted by weighting factor w (w indicates a scalar factor in the range $0 \le w \le 1$) from the first spectrum $|X_1(f)|$, e.g., a first magnitude value of the third magnitude spectrum $|M_1(f)|$ weighted by weighting factor w is spectrally subtracted from a first magnitude value of the first magnitude spectrum $|X_1(f)|$; a second magnitude value of the third magnitude spectrum $|M_1(f)|$ weighted by weighting factor w is spectrally subtracted from a second magnitude value of the first magnitude spectrum $|X_1(f)|$; etc. By this, a plurality of first magnitude side values is obtained as modification information. The first magnitude side values are magnitude values of a magnitude spectrum $\hat{S}_l(f)$ of the first side channel of the stereo side signal when the result of the spectral subtraction is positive. Thus, the first spectral subtraction unit 215 is adapted to apply the formula:

$$\hat{S}_l(f)=|X_1(f)|-w|M_1(f)| \tag{16}$$

Similarly, a second spectral subtraction unit 218 of the spectral subtractor 210 subtracts the third spectrum $|M_1(f)|$ being weighted by weighting factor w (w indicates a scalar factor in the range $0 \le w \le 1$) from the second spectrum $|X_r(f)|$, e.g., a first magnitude value of the third magnitude spectrum $|M_1(f)|$ weighted by weighting factor w is spectrally subtracted from a second magnitude value of the second magnitude spectrum $|X_r(f)|$; a second magnitude value of the third magnitude spectrum $|M_1(f)|$, weighted by weighting factor w is spectrally subtracted from a second magnitude value of the second magnitude spectrum $|X_r(f)|$; etc. Thus, a plurality of second magnitude side values is obtained as modification information, wherein the second magnitude side values are magnitude values of a magnitude spectrum $\hat{S}_r(f)$ of the second side channel of the stereo side signal when the result of the spectral subtraction is positive. By this, the second spectral subtraction unit 218 is adapted to apply the formula:

$$\hat{S}_r(f)=|X_r(f)=|-w|M_1(f) \tag{17}$$

Figure 3:
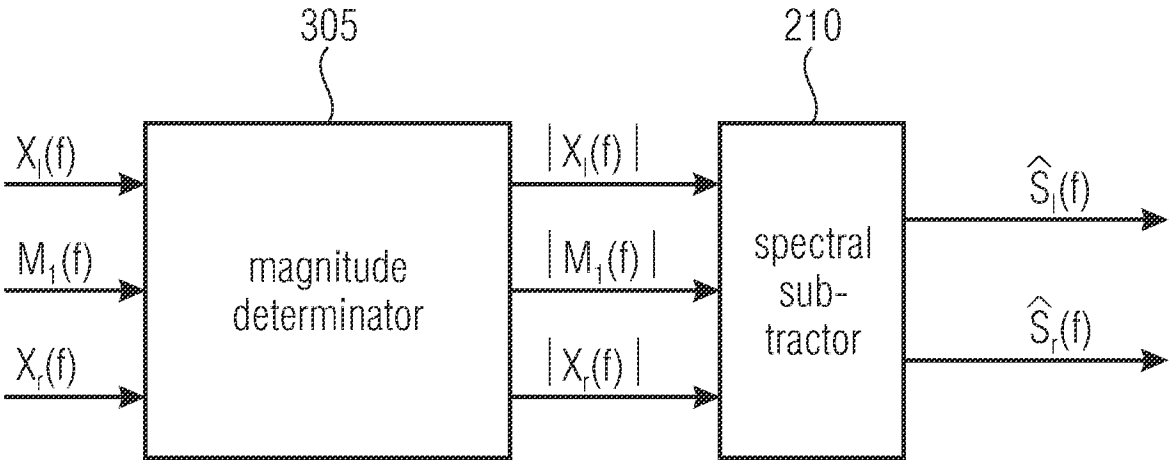
FIG. 3 illustrates a modification information generator according to an embodiment.

FIG. 3 illustrates a modification information generator according to an embodiment.

The modification information generator comprises a magnitude determinator 305 and a spectral subtractor 210. The magnitude determinator 305 is arranged to receive the first $X_1(f)$ and the second $X_r(f)$ input channel and a mono mid signal $M_1(f)$ of the stereo input signal. A first magnitude value of a first magnitude spectrum $|X_1(f)|$ of the first input channel $X_1(f)$, a second magnitude value of a second magnitude spectrum $|X_r(f)|$ of the second input channel $X_r(f)$ and a third magnitude value of a third magnitude spectrum $|M_1(f)|$ of the mono mid signal $M_1(f)$ is determined by the magnitude determinator. The magnitude determinator 305 feeds the first, the second and the third magnitude value into a spectral subtractor 210. The spectral subtractor may be a spectral subtractor according to FIG. 2 which is adapted to generate a first stereo side magnitude value of a magnitude spectrum $\hat{S}_1(f)$ of the first side channel $S_1(f)$ and a second stereo side magnitude value of a magnitude spectrum $\hat{S}_r(f)$ of the second side channel $S_r(f)$.

Figure 4:
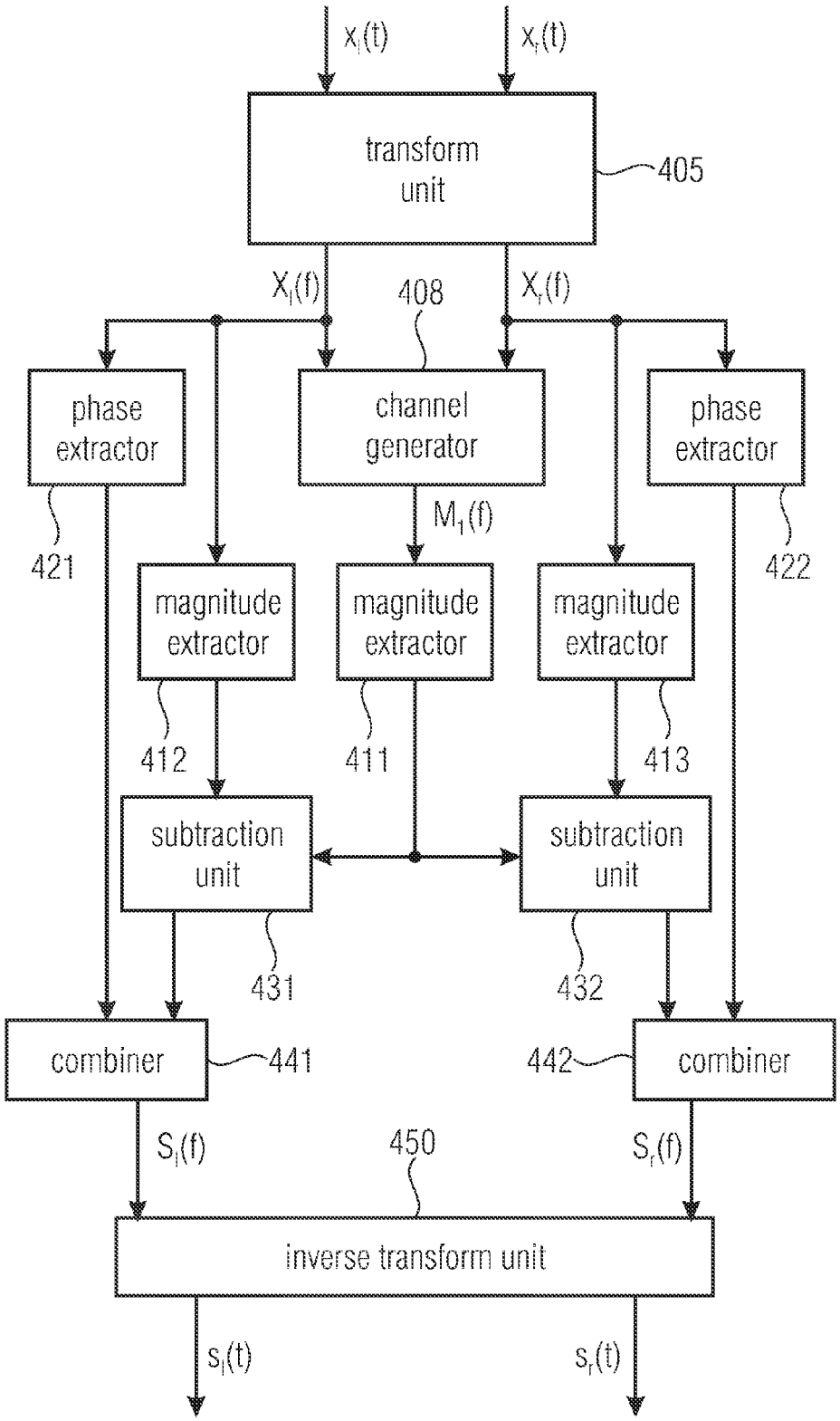
FIG. 4 illustrates an apparatus for generating a stereo side signal and a stereo mid signal for conducting a spectral subtraction according to an embodiment.

FIG. 4 illustrates an apparatus conducting a spectral subtraction according to an embodiment. A first input channel $x_1(t)$ and a second input channel $x_r(t)$ being represented in a time domain are set into transform unit 405. The transform unit 405 is adapted to transform the first and second time-domain input channel $x_1(t)$, $x_r(t)$ from the time domain into a spectral domain to obtain a first spectral-domain input channel $X_1(f)$ and a second spectral-domain input channel $X_r(f)$. The spectral-domain input channels $X_1(f)$, $X_r(f)$ are fed into a channel generator 408. The channel generator 408 is adapted to generate a mono-mid signal $M_1(f)$. The mono-mid signal $M_1(f)$ may be generated according to the formula:

$$M_1(f)=\tfrac{1}{2}(X_1(f)+X_r(f)) \tag{17a}$$

The channel generator 408 feeds the generated mid signal $M_1(f)$ into a first magnitude extractor 411 which extracts magnitude values from the generated mid signal $M_1(f)$. Furthermore, the first input channel $X_1(f)$ is fed by the transform unit 405 into a second magnitude extractor 412 which extracts magnitude values of the first input channel $X_1(f)$. Furthermore, the transform unit 405 feeds the second input channel $X_r(f)$ into a third magnitude extractor 413 which extracts magnitude values from the second input channel. The transform unit 405 also feeds the first input channel $x_1(f)$ into a first phase extractor 421 which extracts phase values from the first input channel $X_1(f)$. Furthermore, the transform unit 405 also feeds the second input channel $X_r(f)$ into a second phase extractor 422 which extracts phase values from the second input channel.

Returning to the first magnitude extractor 411, the magnitude values of the generated mono-mid signal $|M_1(f)|$ are fed into a first subtractor 431. Moreover, the extracted magnitude values $|X_1(f)|$ are fed into the first subtractor 431. The first subtractor 431 generates a difference value between a magnitude value of the first input channel and a magnitude value of the generated mid-signal. The magnitude of the generated mid signal may be weighted. For example, the first subtractor may calculate the difference value according to the formula 16:

$$\hat{S}_l(f)=|X_1(f)|-w|M_1(f)| \tag{16}$$

Similarly, the third magnitude extractor 413 feeds the magnitude values $|X_r(f)|$ into a second subtractor 432. Furthermore, the magnitude values $|M_1(f)|$ are also fed into the second subtractor 432. Similarly to the first subtraction unit 431, the second subtraction unit 432 generates a magnitude value of the second side channel by subtracting the magnitude values $|X_r(f)|$ and the magnitude values of the generated mid signal. The second subtraction unit 432 may, for example, employ the formula:

$$\hat{S}_r(f)=|X_r(f)|-w|M_1(f)| \tag{17}$$

The first subtraction unit 431 then feeds the generated magnitude value $\hat{S}_l(f)$ into a first combiner 441. Moreover, the first phase extractor 421 feeds an extracted phase value of the first input channel $X_1(f)$ into the first combiner 441. The first combiner 441 then generates the spectral-domain values of the first side channel by combining the magnitude value generated by the first subtraction unit 431 and the phase value delivered by the first phase extractor 421. For example, the first combiner 441 may employ the formula:

$$S_l(f)=\hat{S}_l(f)\exp(2\pi\Phi_l(f)i) \tag{18}$$

If some of the values of $\hat{S}_l(f)$ are negative, applying the formula $S_l(f)=\hat{S}_l(f)\exp(2\pi\Phi_l(f)i)$ results in a combination of the absolute value of $\hat{S}_l(f)$ and $\exp(2\pi\Phi_l(f)i)$, wherein $\Phi_l(f)$ is shifted in phase by $\pi$.

Similarly, the second subtraction unit 432 feeds a generated magnitude value $\hat{S}_r(f)$ of the second side signal into a second combiner 442. The second phase extractor 422 feeds an extracted phase value of the second input channel $X_r(f)$ into the second combiner 442. The second combiner is adapted to combine the second magnitude value delivered by the second subtraction unit 432 and the phase value delivered by phase extractor 422 to obtain a second side channel. For example, the second combiner 442 may employ the formula:

$$S_r(f)=\hat{S}_r(f)\exp(2\pi\Phi_r(f)i) \tag{19}$$

If some of the values of $\hat{S}_r(f)$ are negative, applying the formula $S_r(f)=\hat{S}_r(f)\exp(2\pi\Phi_r(f)i)$ results in a combination of the absolute value of $\hat{S}_r(f)$ and $\exp(2\pi\Phi_r(f)i)$, wherein $\Phi_r(f)$ is shifted in phase by $\pi$.

The first combiner 441 feeds the generated first side signal being represented in a spectral-domain into an inverse transform unit 450. The inverse transform unit 450 transforms the first spectral-domain side channel from a spectral-domain into a time domain to obtain a first time-domain side signal. Moreover, the inverse transform unit 450 receives the second side channel being represented in a spectral domain from the second combiner 442. The inverse transform unit 450 transforms the second spectral-domain side channel from a spectral domain into a time-domain to obtain a time-domain second side channel.

As already explained, the magnitude values of the first and the second side channel may be generated by the first subtraction unit 431 and the second subtraction unit 432 according to the formulae:

$$\hat{S}_l(f)=|X_1(f)|-w|M_1(f)| \tag{16}$$

$$\hat{S}_r(f)=|X_r(f)|-w|M_1(f)| \tag{17}$$

A scalar factor $0\leq w\leq 1$ controls the degree of separation. The result of the spectral subtraction are the magnitude spectra of the stereo side signals $\hat{S}_l(f)$ and $\hat{S}_r(f)$.

The time signal $m(t)=[m_1(t)\ m_r(t)]$ is computed by subtracting the stereo side signal from the input signal.

$$m_1(t)=x_1(t)-s_1(t) \tag{20}$$

$$m_r(t)=x_r(t)-s_r(t) \tag{21}$$

The fact that the mid signal is computed by subtracting time signals, only two inverse frequency transforms are necessitated. The parameter w may be chosen to be close to 1, but can be frequency-dependent.

Figure 5:
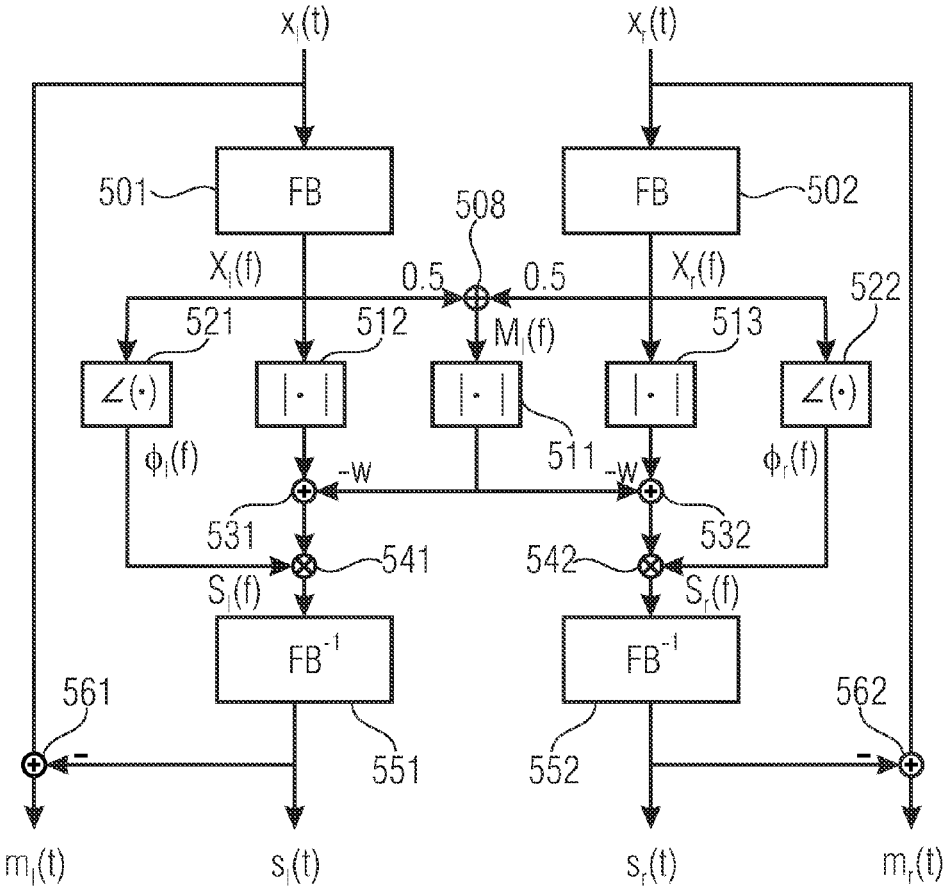
FIG. 5 illustrates an apparatus for generating a stereo side signal and a stereo mid signal according to another embodiment.

FIG. 5 illustrates an apparatus according to an embodiment employing these concepts.

The apparatus furthermore comprises a first transform unit 501 being adapted to transform the first time-domain input channel $x_1(t)$ from the time domain into a spectral domain to obtain a first spectral-domain input channel $X_1(f)$, and a second transform unit 502 being adapted to transform the second time-domain input channel $x_r(t)$ from the time domain into a spectral domain to obtain a second spectral-domain input channel $X_r(f)$.

The apparatus furthermore comprises a channel generator 508, a first 511, second 512 and third 513 magnitude extractor, a first 521 and a second 522 phase extractor, a first 531 and a second 532 subtraction unit and a first 541 and a second 542 combiner, which may correspond to the channel generator 408, the first 411, second 412 and third 413 magnitude extractor, the first 421 and second 422 phase extractor, the first 431 and second 432 subtraction unit and the first 441 and a second 442 combiner of the apparatus of FIG. 4, respectively.

Moreover, the apparatus comprises a first inverse transform unit 551. The first inverse transform unit 551 receives a generated first side channel being represented in a spectral domain from the first combiner 541. The first inverse transform unit 551 transforms a generated first spectral-domain side channel $S_1(f)$ from a spectral-domain into a time domain to obtain a first time-domain side channel $s_1(t)$.

Furthermore, the apparatus comprises a second inverse transform unit 552. The second inverse transform unit 552 receives a generated second side channel being represented in a spectral domain from the second combiner 542. The second inverse transform unit 552 transforms the second spectral-domain side channel $S_r(f)$ from a spectral domain into a time-domain to obtain a second time-domain side channel $s_r(t)$.

Moreover, the apparatus comprises a first mid channel generator 561. The first mid channel generator 561 generates a first mid channel $m_1(t)$ of a stereo mid signal in a time domain be applying formula 20:

$$m_1(t)=x_1(t)-s_1(t) \tag{20}$$

Furthermore, the apparatus comprises a second mid channel generator 562. The second mid channel generator 562 generates a first mid channel $m_r(t)$ of a stereo mid signal in a time domain be applying formula 21:

$$m_r(t)=x_r(t)-s_r(t) \tag{21}$$

The identical results are obtained by implementing this processing using spectral weighting (similarly to the processing in the above-described section "Background") as exemplarily shown for the left channel here. The complex-valued spectra $X_1(f)$ are weighted as shown in the following equation:

$$S_l(f)=\frac{|X_l(f)|-|M(f)|}{|X_l(f)|}X_l(f) \tag{22}$$

Although the above equation yields the identical result with actual weighting as obtained with spectral subtraction (but with larger computational load; mostly due to the division for computing the spectral weights), the spectral weighting approach has advantages because it offers more possibilities for parameterizing the processing which leads to different results with similar characteristics, as described in the following:

Signal decomposition using spectral weighting is now explained in more detail. The rationale of the concept according to this embodiment is to apply spectral weighting to the left and the right channel signals $x_1(t)$ and $x_r(t)$, where the spectral weights are derived from the M-S composition. An intermediate result of the M-S decomposition is the ratio of mid and side signal per time-frequency tile, in the following referred to as mid-side ratio (MSR). This MSR can be used to compute the spectral weights, but it is noted that the weights can be computed alternatively without the notion of the MSR. In this case, the MSR mainly serves the purpose of explaining the basic idea of the method. For computing the stereo mid-signal $m(t)=[m_1(t)\ m_r(t)]$, weights are chosen such that they are monotonically related to the MSR. For computing the stereo side signal $s(t)=[s_1(t)\ s_r(t)]$, the weights are chosen such that they are monotonically related to the inverse of the MSR.

Figure 6:
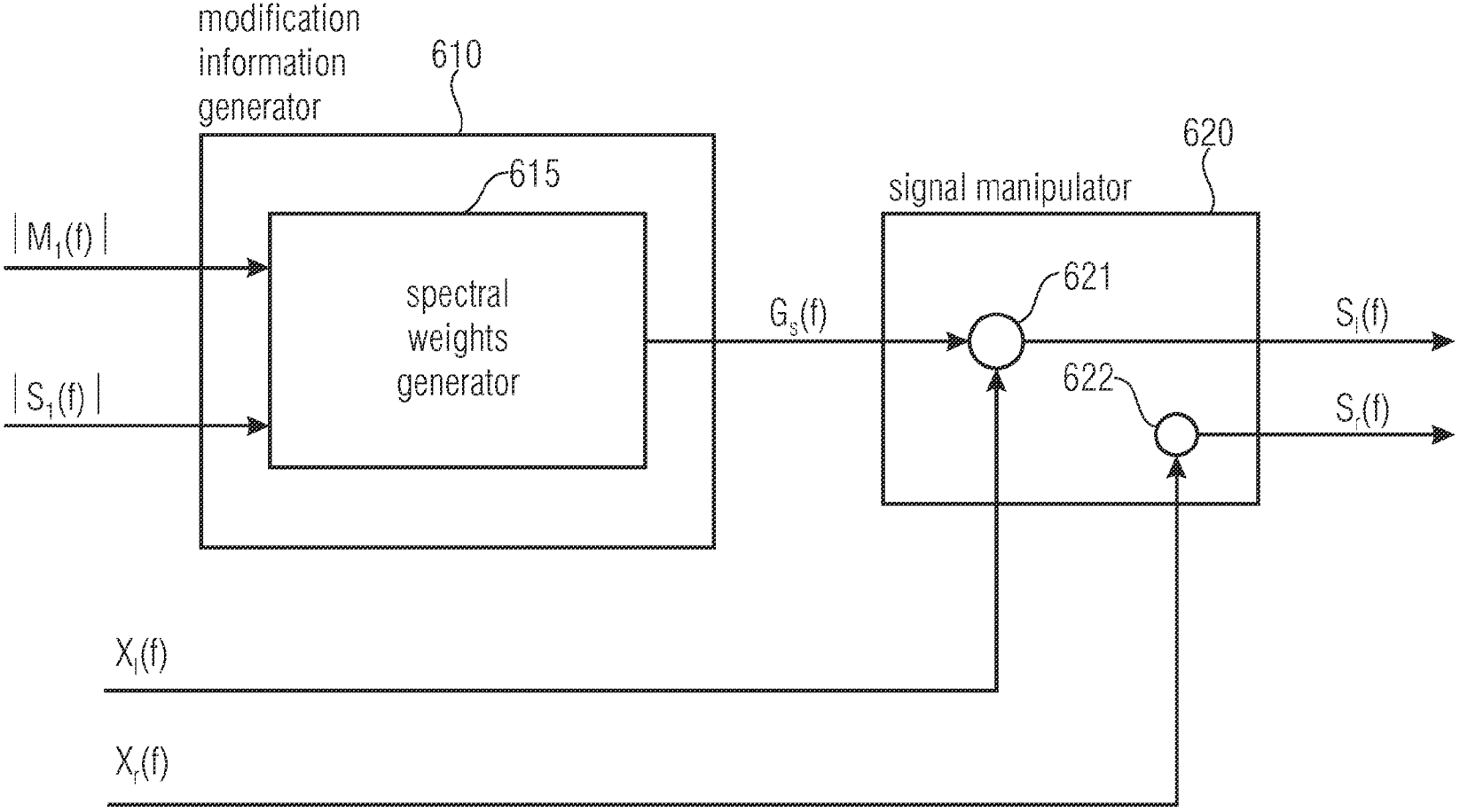
FIG. 6 illustrates an apparatus for generating a stereo side signal, wherein the apparatus comprises a spectral weights generator according to an embodiment.

In an embodiment, a modification information generator comprises a spectral weights generator. FIG. 6 illustrates an apparatus according to such an embodiment. The apparatus comprises a modification information generator 610 and a signal manipulator 620. The modification information generator comprises a spectral weights generator 615. The signal manipulator 620 comprises a first manipulation unit 621 for manipulation a first input channel $X_1(f)$ of a stereo signal and a second manipulation unit 622 for manipulating a second input channel $X_r(f)$ of the stereo input signal. The spectral weights generator 615 of FIG. 6 receives a mono mid signal $M_1(f)$ and a mono side signal $S_1(f)$ of the stereo input signal. The spectral weights generator 615 is adapted to determine a spectral weighting factor $G_s(f)$ based on the mono mid signal $M_1(f)$ and on the mono side signal $S_1(f)$ of the stereo input signal. The signal manipulator 620 then feeds the generated spectral weighting factor $G_s(f)$ as modification information into the modification information generator 620. The first modification unit 621 of the modification information generator 620 is adapted to manipulate the first input channel $X_1(f)$ of the stereo input signal based on the generated spectral weighting factor $G_s(f)$ to obtain a first side channel $S_1(f)$ of a stereo side signal.

Figure 7:
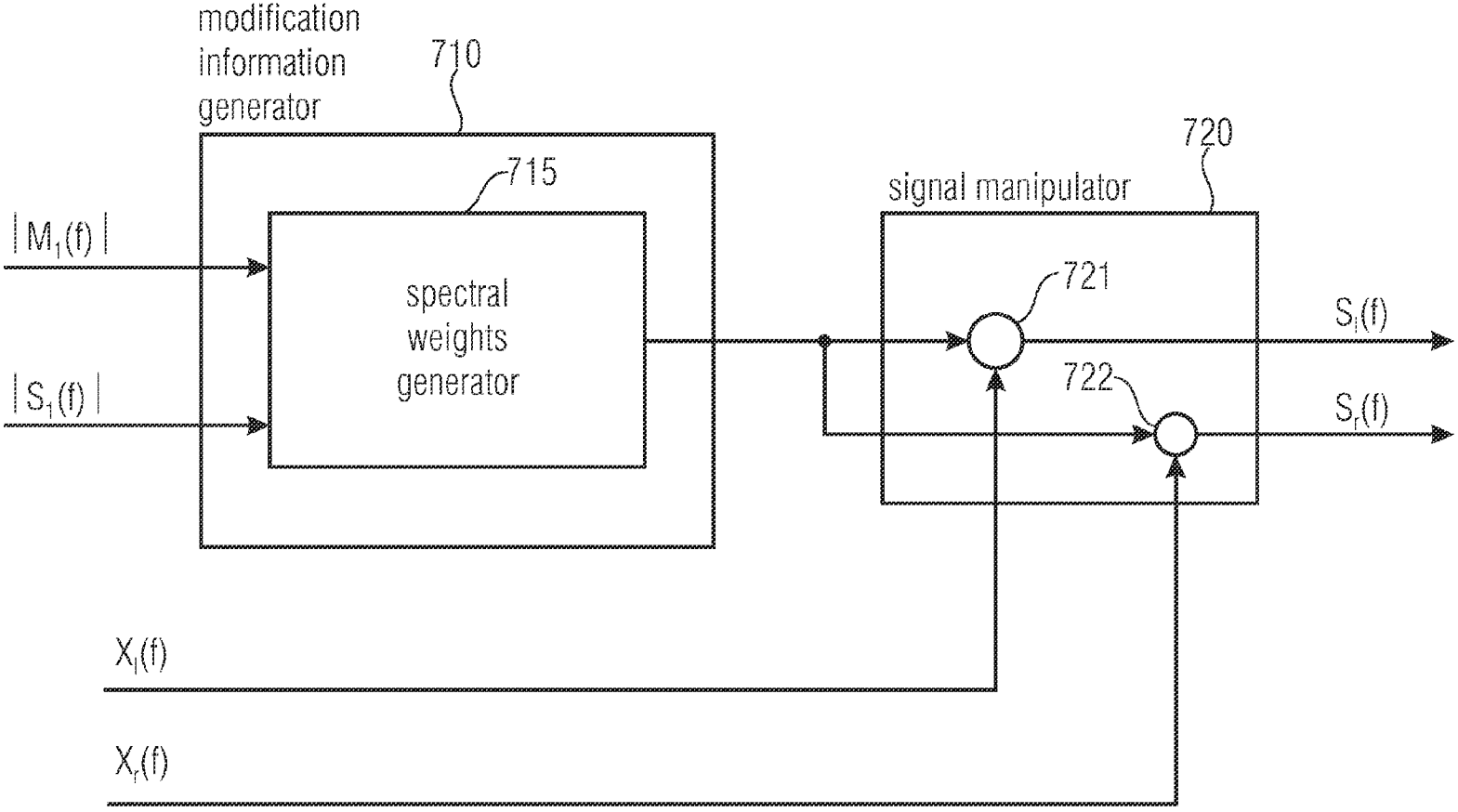
FIG. 7 illustrates an apparatus for generating a stereo side signal wherein the apparatus comprises a spectral weights generator according to another embodiment.

Another embodiment is illustrated in FIG. 7. As the apparatus of FIG. 6, the apparatus of FIG. 7 comprises a modification information generator 710 and a signal manipulator 720. The modification information generator comprises a spectral weights generator 715. The signal manipulator 720 comprises a first manipulation unit 721 for manipulation a first input channel $X_1(f)$ of a stereo signal and a second manipulation unit 722 for manipulating a second input channel $X_r(f)$ of the stereo input signal. The signal manipulator 720 of the embodiment of FIG. 7 is adapted to manipulate a first input channel $X_1(f)$ as well as a second input channel $X_r(f)$ based on the same generated spectral weighting factor $G_s(f)$ to obtain a first $S_1(f)$ and a second $S_r(f)$ side channel of a stereo side signal.

Figure 8:
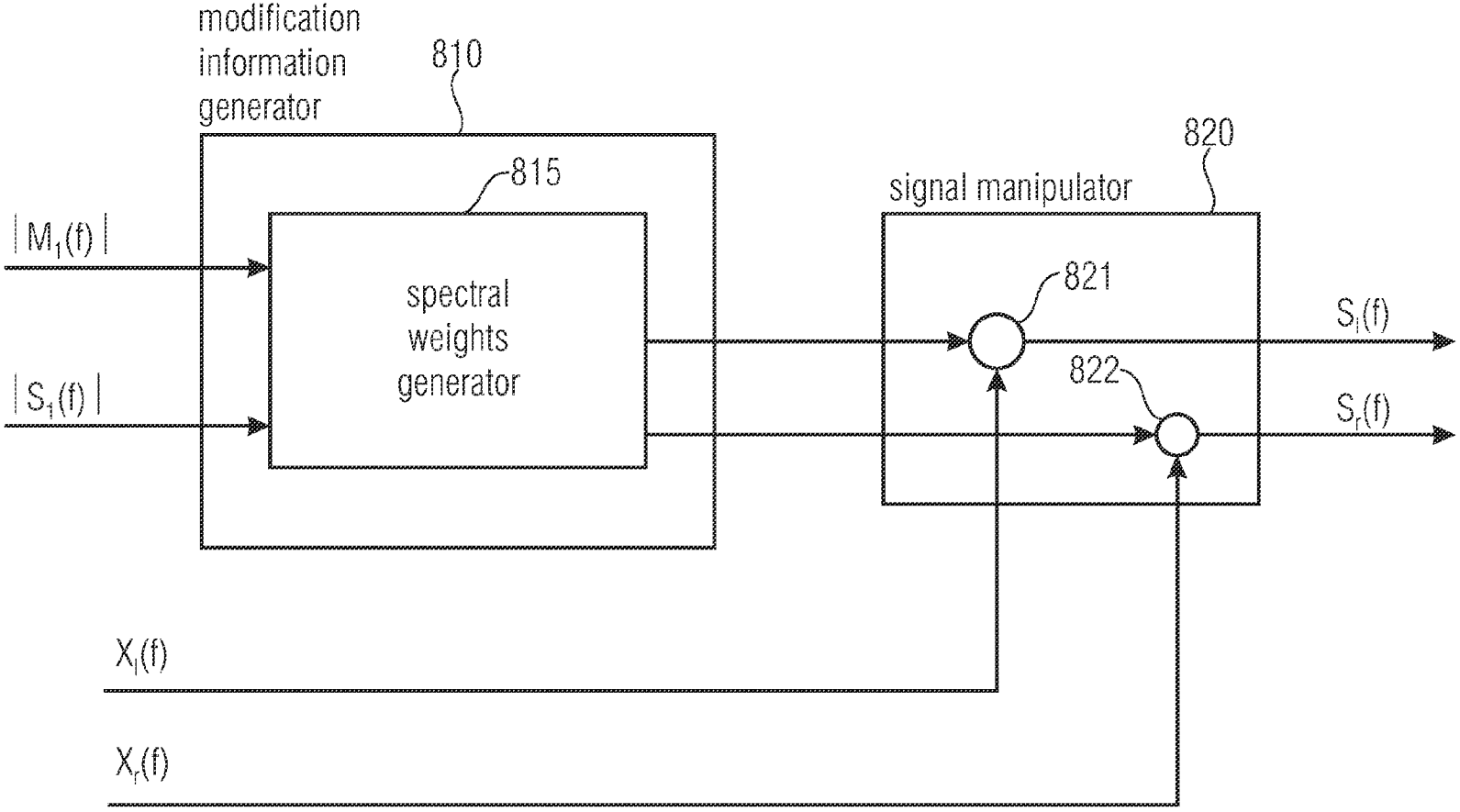
FIG. 8 illustrates an apparatus for generating a stereo side signal wherein the apparatus comprises a spectral weights generator according to a further embodiment.

A further embodiment is illustrated in FIG. 8. As the apparatus of FIG. 6, the apparatus of FIG. 8 comprises a modification information generator 810 and a signal manipulator 820. The modification information generator comprises a spectral weights generator 815. The signal manipulator 820 comprises a first manipulation unit 821 for manipulation a first input channel $X_1(f)$ of a stereo signal and a second manipulation unit 822 for manipulating a second input channel $X_r(f)$ of the stereo input signal. The spectral weights generator 815 is adapted to generate two or more spectral weights factors. Moreover, first manipulation unit 821 of the modification information generator 820 is adapted to manipulate a first input channel based on a generated first spectral weighting factor. The second manipulation unit 822 of the modification information generator 820 is furthermore adapted to manipulate the second input channel based on a generated second spectral weighting factor.

Figure 9:
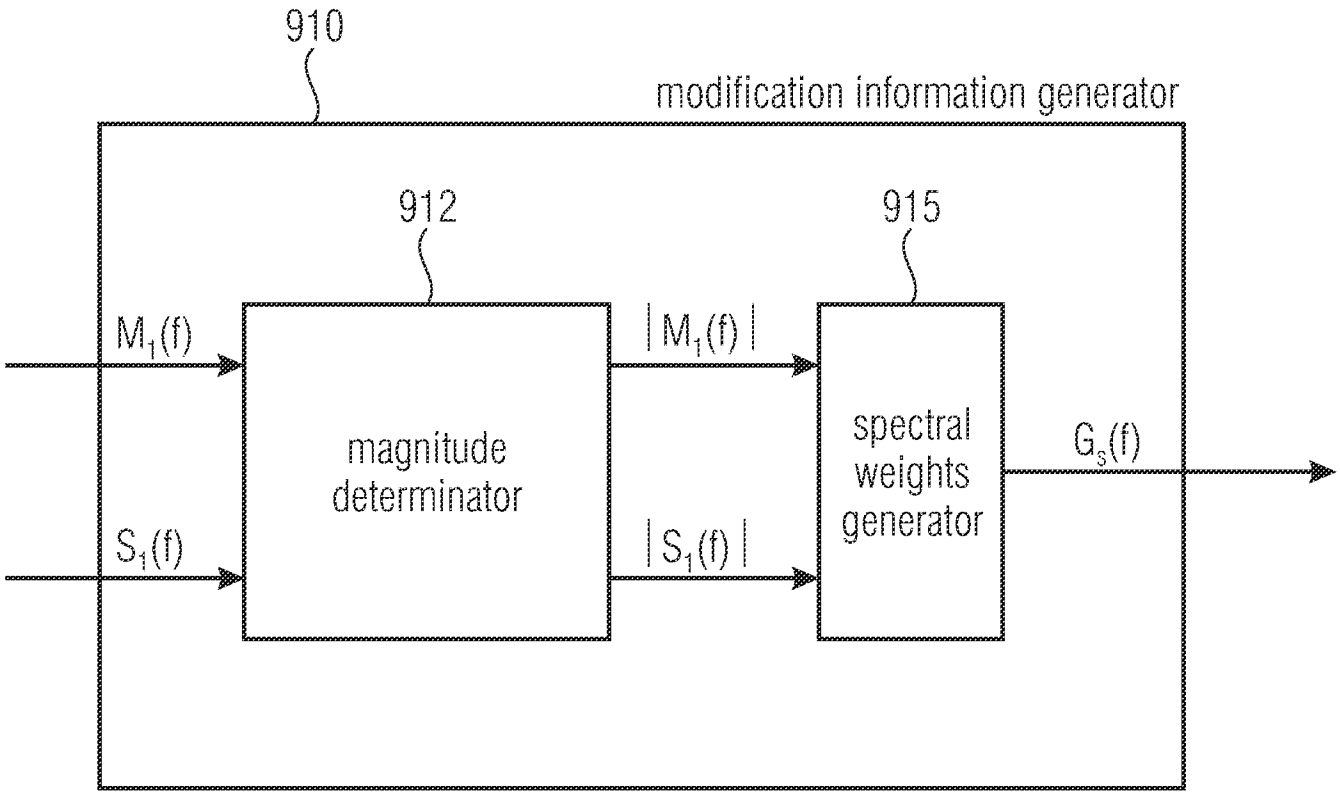
FIG. 9 illustrates a modification information generator wherein the apparatus comprises a spectral weights generator and a magnitude generator according to an embodiment.

FIG. 9 illustrates a modification information generator 910 according to an embodiment. The modification information generator 910 comprises a magnitude determinator 912 and a spectral weights generator 915. The magnitude determinator 912 is adapted to receive the mono mid signal $M_1(f)$ being represented in a spectral domain. Furthermore, the magnitude determinator 912 is adapted to receive the mono side signal $S_1(f)$ being represented in a spectral domain. The magnitude determinator 912 is adapted to determine a magnitude value of a spectrum $|S_1(f)|$ of the mono side signal $S_1(f)$ as a magnitude side value. Furthermore, the magnitude determinator 912 is adapted to determine a magnitude value of a spectrum $|M_1(f)|$ of the mono mid signal $M_1(f)$ as a magnitude mid value.

The magnitude determinator 912 is adapted to feed the magnitude side value and the magnitude mid value into the spectral weights generator 915. The spectral weights generator 915 is adapted to generate the first spectral weighting factor $G_s(f)$ based on a ratio of a first number to a second number, wherein the first number depends on the magnitude side value, and wherein the second number depends on the magnitude mid value and the magnitude side value. For example, the first spectral weighting factor $G_s(f)$ may be calculated according to the formula:

$$G_s(f)=\left(\frac{|S(f)|^{\alpha}}{\delta|S(f)|^{\alpha}+\gamma|M(f)|^{\alpha}}\right)^{\frac{1}{\beta}} \tag{23}$$

wherein $\alpha$, $\beta$, $\gamma$, $\delta$ and $\eta$ are scalar factors.

In the following, computation of the spectral weights is described in more detail. Such spectral weights can be derived by using one of the above-described gaining rules as described in the context of spectral subtraction and spectral weighting in the above section "Background", by substituting the desired signal d(t) and the interfering signal n(t) according to Table 1.

TABLE 1

Assigning the M-S signals to the signals used for computing the spectral weights.

| | desired signal | interferer |
|---|---|---|
| stereo side signal | s(t) | m(t) |
| stereo mid signal | m(t) | s(t) |

For example, the stereo side signal $s(t)=[s_1(t)\ s_r(t)]$ can be computed according to equations (23), (24) and (25).

$$G_s(f)=\left(\frac{|S(f)|^{\alpha}}{\delta|S(f)|^{\alpha}+\gamma|M(f)|^{\alpha}}\right)^{\frac{1}{\beta}} \tag{23}$$

$$S_1(f)=G_s(f)X_1(f) \tag{24}$$

$$S_r(f)=G_s(f)X_r(f) \tag{25}$$

An additional parameter $\delta$ is introduced for controlling the impact of the stereo side signal components in the decomposition process.

It is noted that the frequency transform only needs to be computed either for the signal pair $[x_1(t)\ x_r(t)]$ or $[m(t)\ s(t)]$, and the upper pair is derived by addition and subtractions according to Equations (5) and (6).

In a similar way, the stereo mid signal $m(t)=[m_1(t)\ m_r(t)]$ can be computed according to Equations (26), (27) and (28).

$$G_m(f)=\left(\frac{|M(f)|^{\alpha}}{\gamma|S(f)|^{\alpha}+\delta|M(f)|^{\alpha}}\right)^{\frac{1}{\beta}} \tag{26}$$

-continued $$M_1(f) = G_m(f)X_1(f) \tag{27}$$

$$M_r(f) = G_m(f)X_r(f). \tag{28}$$

Figure 10:
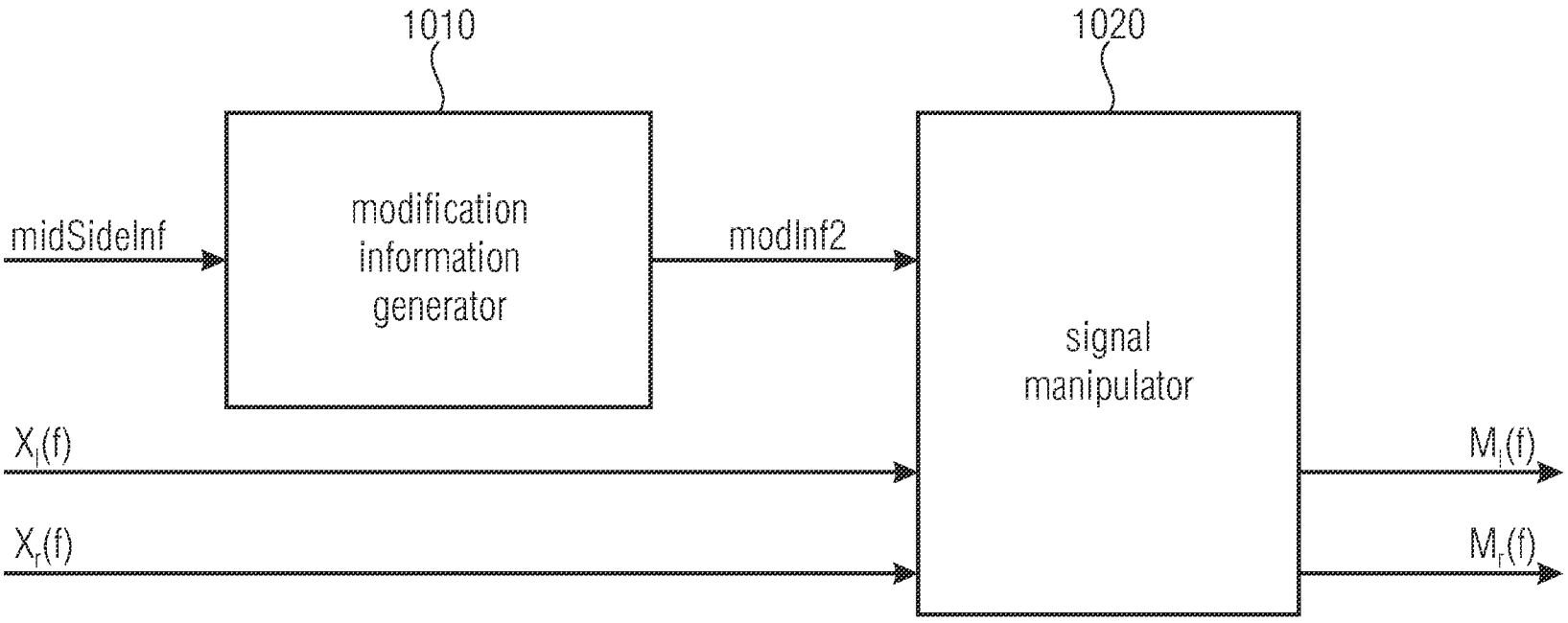
FIG. 10 illustrates an apparatus for generating a stereo mid signal according to an embodiment.

FIG. 10 illustrates an apparatus for generating a stereo mid signal having a first mid channel $M_1(f)$ and a second mid channel $M_r(f)$ from a stereo input signal having a first input channel and a second input channel. The apparatus comprises a modification information generator 1010 for generating modification information modInf2 based on mid-side information midSideInf, and a signal manipulator 1020 being adapted to manipulate the first input channel $X_1(f)$ based on the modification information to obtain the first mid channel $M_1(f)$ and being adapted to manipulate the second input channel $X_r(f)$ based on the modification information modInf to obtain the second mid channel $M_r(f)$.

Figure 10A:
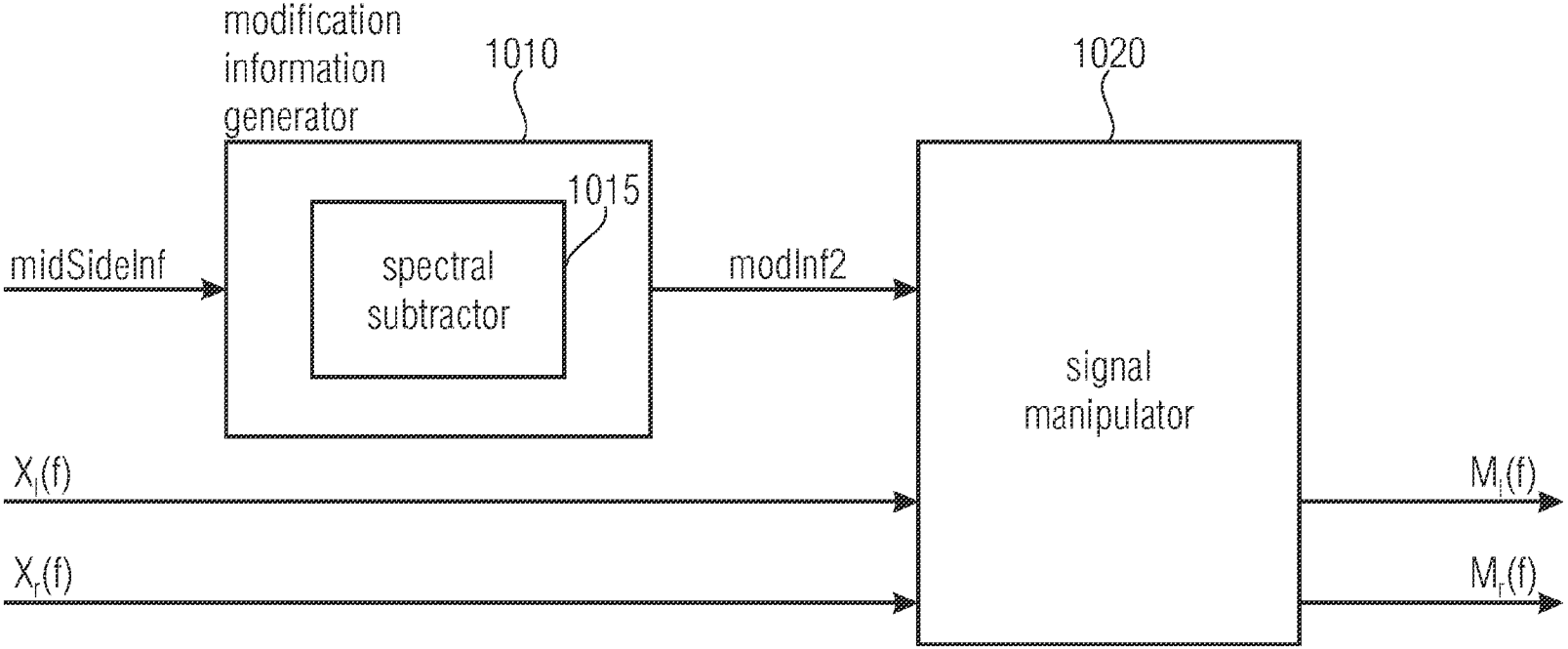
FIG. 10*a* illustrates an apparatus for generating a stereo mid signal according to an embodiment, wherein the manipulation information generator comprises a spectral subtractor.

FIG. 10*a* illustrates an apparatus for generating a stereo mid signal according to an embodiment, wherein the manipulation information generator 1010 comprises a spectral subtractor 1015. The spectral subtractor 1015 is adapted to generate the modification information modInf2 by generating a difference value indicating a difference between a mono mid signal or a mono side signal of the stereo input signal and the first or the second input channel. For example, the spectral subtractor 1015 may be adapted to generate the modification information modInf2 by subtracting a magnitude value or a weighted magnitude value of the first or the second input channel from a magnitude value or a weighted magnitude value of the mono mid signal or the mono side signal of the stereo input signal. Or, the spectral subtractor 1015 may be adapted to generate the modification information modInf2 by subtracting a magnitude value or a weighted magnitude value of the mono mid signal or the mono side signal of the stereo input signal from a magnitude value or a weighted magnitude value of the first or the second input channel.

Figure 10B:
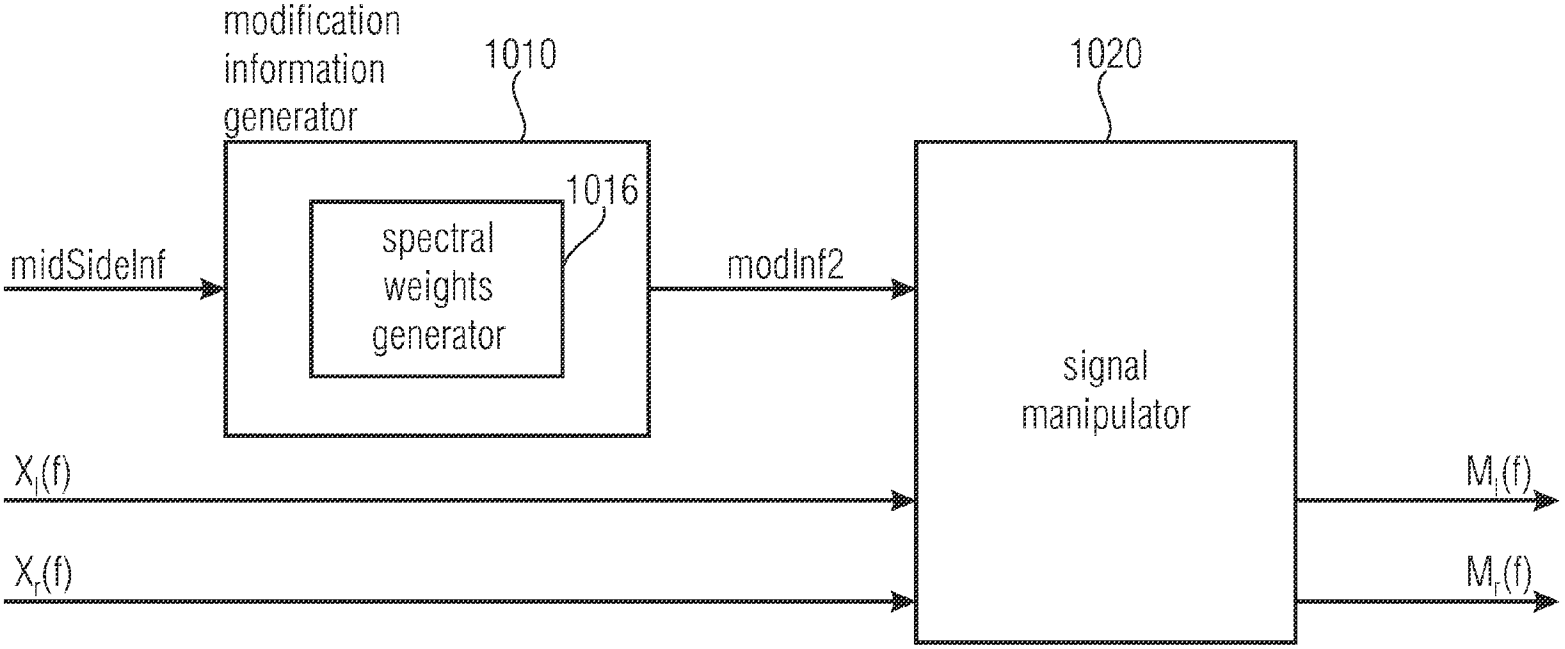
FIG. 10*b* illustrates an apparatus for generating a stereo mid signal according to an embodiment, wherein the modification information generator comprises a spectral weights generator.

FIG. 10*b* illustrates an apparatus for generating a stereo mid signal according to an embodiment, wherein the modification information generator 1010 comprises a spectral weights generator 1016 for generating the modification information modInf2 by generating a first spectral weighting factor based on a mono mid signal and on a mono side signal of the stereo input signal.

The modification information generator may generate the modification information modInf2 for example according to formula 26:

$$G_m(f) = \left(\frac{|M(f)|^\alpha}{\gamma|S(f)|^\alpha + \delta|M(f)|^\alpha}\right)^{\frac{1}{\beta}} \tag{26}$$

An alternative to the weights shown in Equation 26 is to derive the weights from a criterion for downmix compatibility where $G_s(f) + G_m(f) = 1$, leading to $$G_{m2}(f) = \left(\frac{(\delta - 1)|S(f)|^\alpha + \gamma|M(f)|^\alpha}{\delta|S(f)|^\alpha + \gamma|M(f)|^\alpha}\right)^{\frac{1}{\beta}} \tag{29}$$

an extension of the method described above is motivated by the observation that the gain function (23) does not lead a weight equal to 1 even in the case the time-frequency bin is panned hard to one side. This is a consequence of the fact that the denominator is larger than the numerator, since the mid-signal will only approach zero if both, the left and the right spectral coefficient is zero. To achieve $G_s(f)=1$ for hard-panned signal components, the equation (23) can be modified to $$G_s(f) = \left(\frac{|S(f)|^\alpha}{\delta|S(f)|^\alpha + \gamma\min[|X_l(f)|, |X_r(f)|]^\alpha}\right)^{\frac{1}{\beta}} \tag{30}$$

The modification in equation (30) leads to unity gains for hard-panned components. Alternatively, equations (31) and (32) show gain formulas with a parameter η, whose results equal equation (23) for η=0 and (30) for η=1.

$$G_s(f) = \left(\frac{|S(f)|^\alpha}{\delta|S(f)|^\alpha + \gamma Q(f)^\alpha}\right) \tag{31}$$

with $$Q(f) = \eta\min[|X_l(f)|, |X_r(f)|] + (1 - \eta)M(f) \tag{32}$$

It is noted that a spectral weighting described above does not guarantee downmix compatibility in all cases, i.e.

$$x_1 = s_1 + m_1 \tag{33}$$

$$x_r = s_r + m_r \tag{34}$$

If an energy preserving separation is desired, the weights need to be chosen such that $$G_s(f) + G_m(f) = 1 \tag{35}$$

which can be solved by computing either $$G_s(f) \text{ or } G_m(f) \tag{36}$$

as described above and computing the other weighting factors accordingly, e.g. as $$G_m(f) = \bar{1} - G_s(f) \tag{37}$$

Optionally, an additional constant scaling factor can be applied to one of the gain functions before the subtraction.

For the example of quadraphonic playback with downmix compatibility, the parameters can be set to $$\gamma = 1,\ \delta = 1,\ \eta = 0 \tag{38}$$

The spectral weights $G_s(f)$ are computed first and scaled by 1.5 dB. The gains for the stereo mid signal are computed as $G_m(f) = 1 - G_s(f)$.

Figure 11:
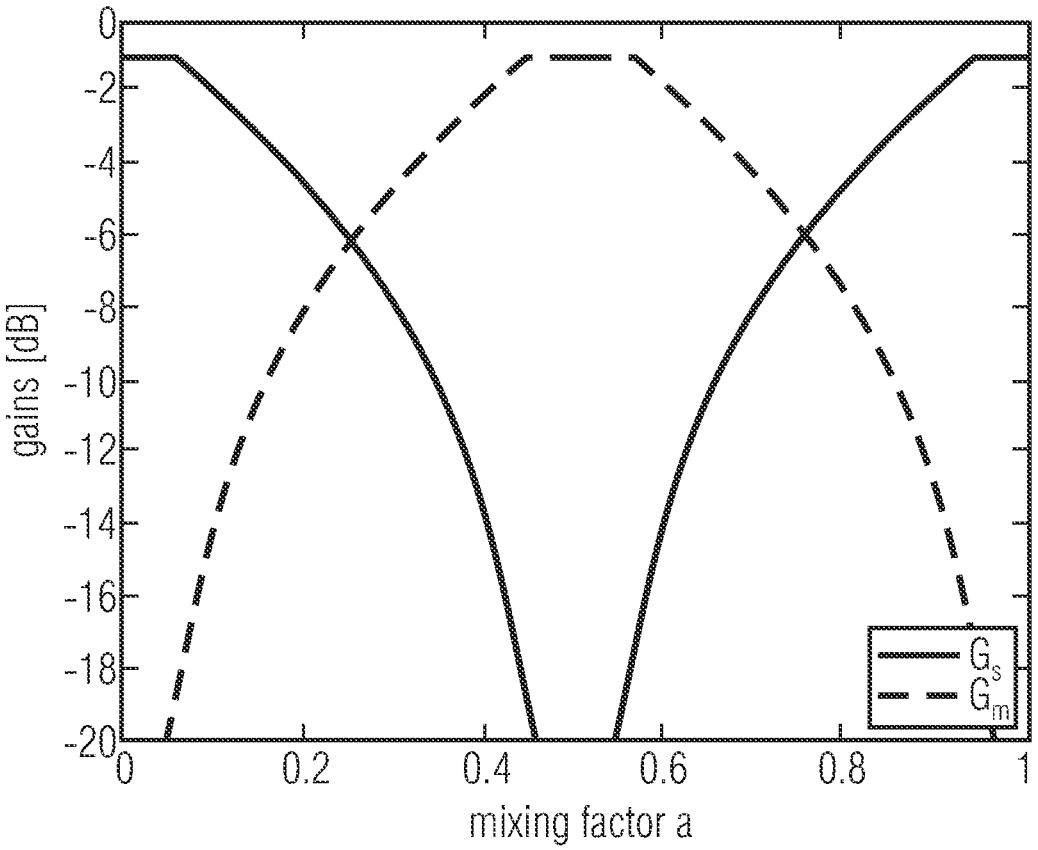
FIG. 11 illustrates example gains for stereo side signals and stereo mid signals.
Figure 12:
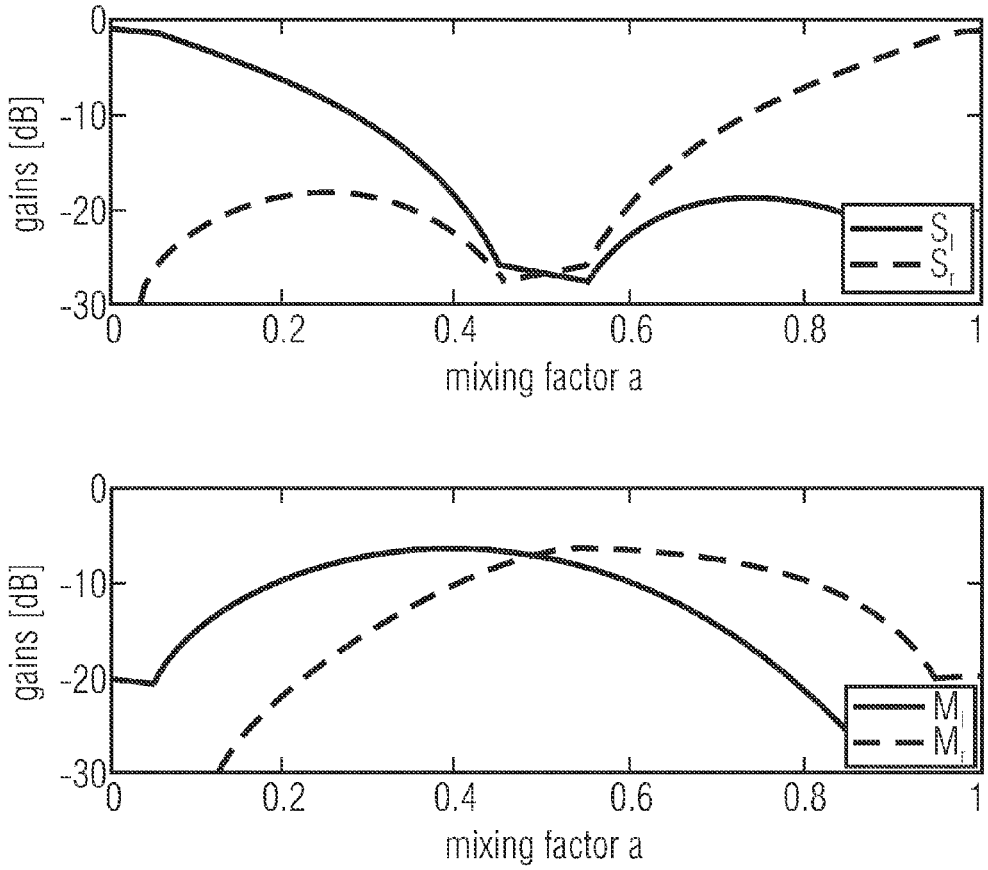
FIG. 12 illustrates results of spectral weighting for stereo side signals and stereo mid signals.

The gain functions are illustrated as a function of the panning parameter a in FIG. 11. In FIG. 11, example gains for stereo side signals (solid line) and stereo mid signals (dashed line) are illustrated. It is shown that the gains are complementary, i.e., the separation is downmix compatible. Signal components which are panned to either one side are attenuated in the stereo mid signal, and signal components which are panned to the center are attenuated in the stereo side signal. Signal components which are panned in between appear in both signals. The gain functions are illustrated as a function of the panning parameter a in FIG. 12. FIG. 12 illustrates the results of the spectral weighting for stereo side signals (upper figure) and stereo mid signals (lower figure) for the left (solid line) and right channel (dashed line).

Figure 13:
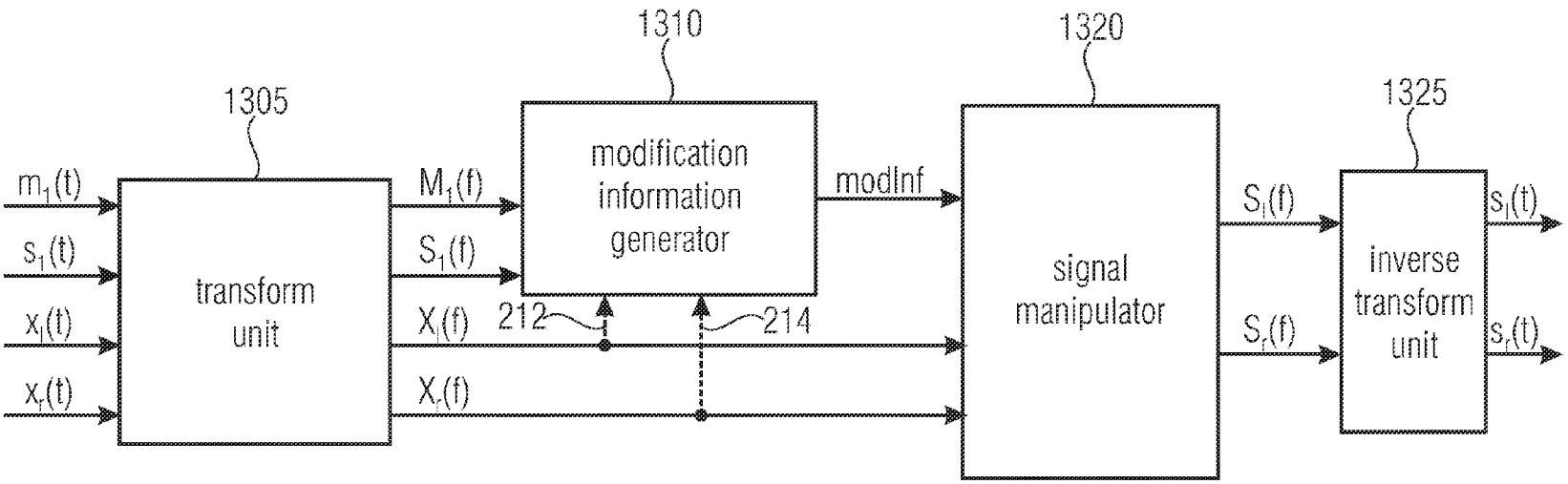
FIG. 13 illustrates an apparatus for generating a stereo side signal according to a further embodiment.

FIG. 13 illustrates an apparatus for generating a stereo side signal according to a further embodiment. The apparatus comprises a transform unit 1203, a modification information generator 1310, a signal manipulator 1320 and an inverse transform unit 1325. A first input channel $x_1(t)$ and a second input channel $x_r(t)$ of a stereo input signal and a mid signal $m_1(t)$ and a side signal $s_1(t)$ of the stereo input signal are fed into the transform unit 1305. The transform unit may be a Short-Time Fourier transform unit (STFT unit), a filter bank, or any other means for deriving a signal representation with multiple frequency bands X(f, k), with frequency band index f and time index k. The transform unit transforms the mid signal $mid_1(t)$, the side signal $s_1(t)$, the first input channel $x_1(t)$ and the second input channel $x_r(t)$ being represented in a time-domain into spectral-domain signals, in particular, into a spectral-domain mid-signal $M_1(f)$, a spectral-domain side signal $S_1(f)$, a spectral-domain first input channel $X_1(f)$ and a spectral-domain second input channel $X_r(f)$. The spectral-domain mid signal $M_1(f)$ and the spectral-domain side signal $S_1(f)$ are fed into the modification information generator 1310 as mid-side information.

The modification information generator 1310 generates modification information modInf based on the spectral-domain mono mid signal $M_1(f)$ and the mono-side signal $S_1(f)$. The modification information generator of FIG. 13 may also take the first input channel $X_1(f)$ and/or the second input channel $X_r(f)$ into account as indicated by the dashed connection lines 1312 and 1314. For example, the modification information generator 1310 may generate the modification information which is based on the mono-mid signal $M_1(f)$, the first input channel $X_1(f)$ and the second input channel $X_r(f)$.

The modification generator 1310 then passes the generated modification information modInf to the signal manipulator 1320. Moreover, the transform unit 1305 feeds the first spectral-domain input channel $X_1(f)$ and the second spectral-domain input channel $X_r(f)$ into the signal manipulator 1320. The signal manipulator 1320 is adapted to manipulate the first input channel based on the modification information modInf to obtain a first spectral-domain side channel $S_1(f)$ and a second spectral-domain side channel $S_r(f)$ which are fed into the inverse transform unit 1325 by the signal manipulator 1320.

The inverse transform unit 1325 is adapted to transform the first spectral-domain side channel $S_1(f)$ into a time domain to obtain a first time-domain side channel $s_1(t)$, and to transform the second spectral-domain side channel $S_r(f)$ into a time domain to obtain a second time-domain side channel $s_r(t)$, respectively.

Figure 14:
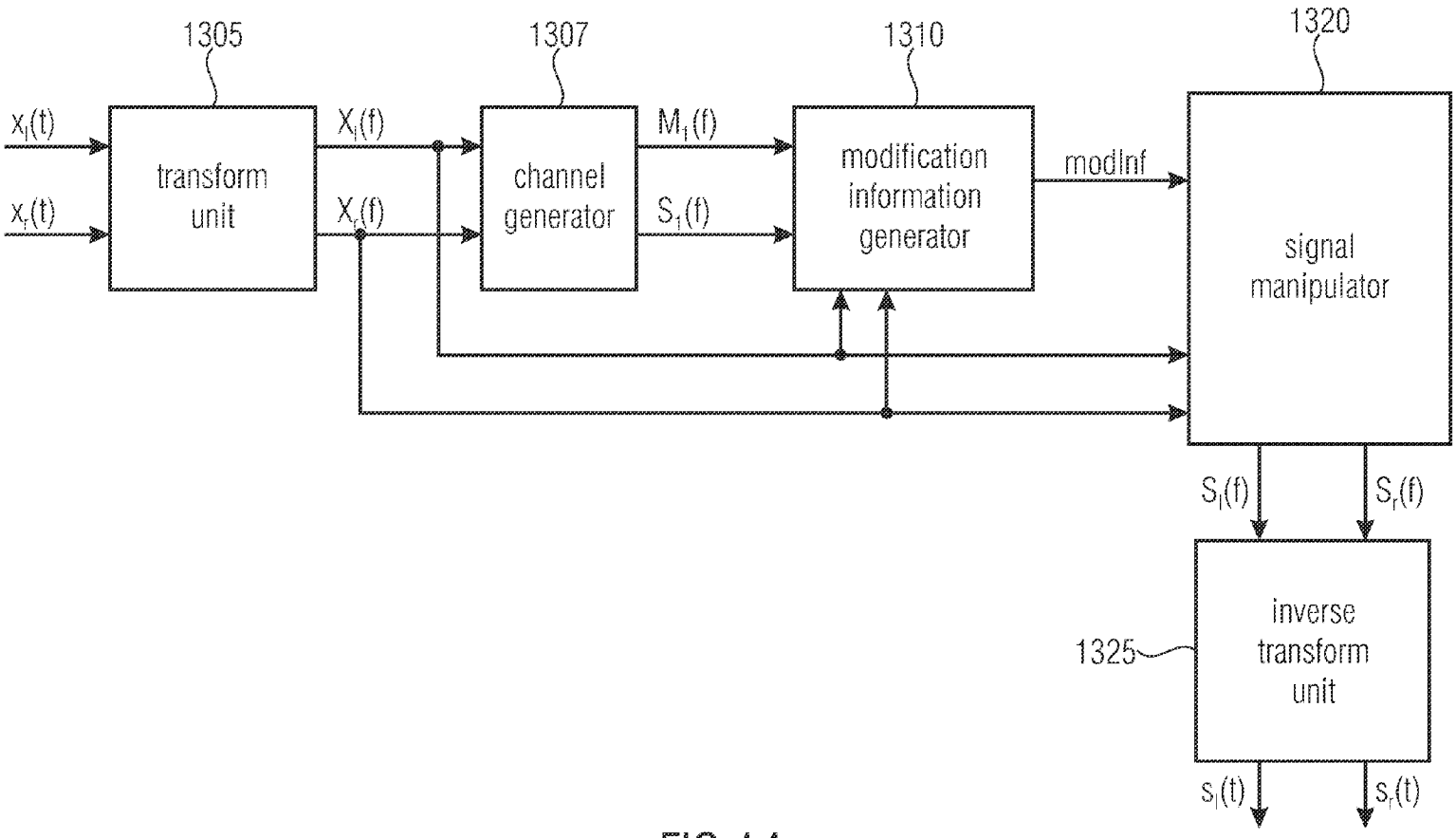
FIG. 14 illustrates an apparatus for generating a stereo side signal according to a further embodiment.

FIG. 14 illustrates an apparatus for generating a stereo side signal according to a further embodiment. The apparatus illustrated by FIG. 14 differs from the apparatus of FIG. 13 in that the apparatus of FIG. 14 furthermore comprises a channel generator 1307, which is adapted to receive the first input channel $X_1(f)$ and the second input channel $X_r(f)$, and to generate a mono mid signal $M_1(f)$ and/or a mono-side signal $S_1(f)$ from the first and the second input channel $X_1(f)$, $X_r(f)$. For example, the mono mid signal $M_1(f)$ may be generated according to the formula:

$$M_1(f)=\tfrac{1}{2}(X_1(f)+X_r(f)).$$

The mono-side signal $S_1(f)$ may, for example, be generated according to the formula:

$$S_1(f)=\tfrac{1}{2}(X_1(f)-X_r(f)).$$

The rationale of the proposed method is to compute an estimate of the magnitude spectra of the desired signals, namely of $m(t)=[m_1(t)\ m_r(t)]$ and $s=[s_1(t)\ s_r(t)]$ by processing the input signal $x(t)=[x_1(t)\ x_r(t)]$ and taking advantage of the fact that the frequency-domain representation of $m_1(t)$ and $s_1(t)$ comprises the desired signal components.

In one embodiment, spectral subtraction is employed. The spectra of the input signals are modified using the spectra of the monophonic mid signal. In another embodiment, spectral weighting is employed, where the weights are derived using the monophonic mid signal and the monophonic side signal.

According to embodiments, signals shall be computed with similar characteristics as mid and side signal, but without losing the stereo signal when listening to each of the signals separately. This is achieved by using spectral subtraction in one embodiment and by using spectral weighting in another embodiment.

According to another embodiment, an upmixer is provided for generating at least four upmix channels from a stereo signal having two upmixer input channels.

The upmixer comprises an apparatus to generate a stereo side signal according to one of the above-described embodiments to generate a first side channel as the first upmix channel, and for generating a second side channel as a second upmix channel. The upmixer further comprises a first combination unit and a second combination unit. The first combination unit is adapted to combine the first input channel and the first side channel to obtain a first mid channel as a third upmixer channel. Moreover, the second combination unit is adapted to combine the second input channel and the second side channel as a fourth upmixer channel.

Figure 15:
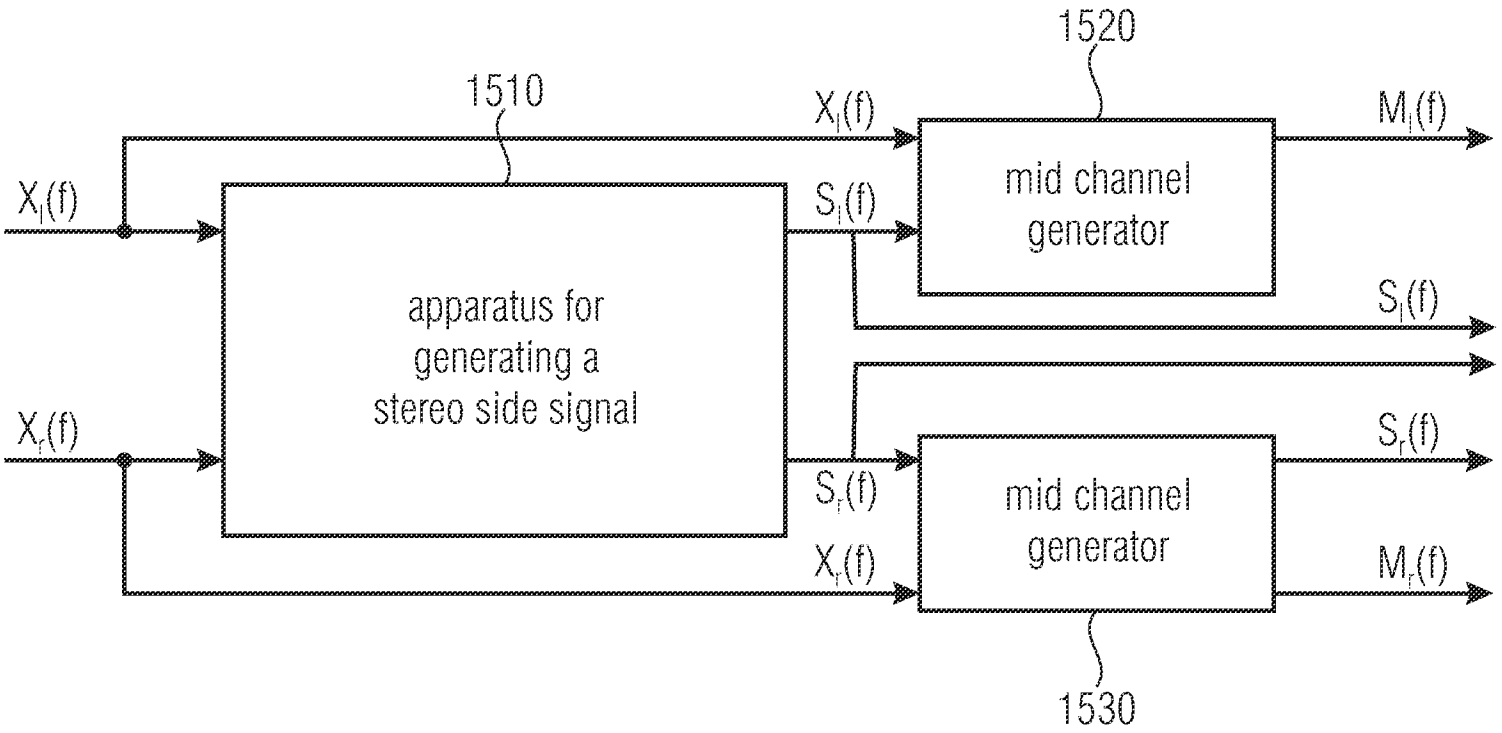
FIG. 15 illustrates an upmixer according to an embodiment.

FIG. 15 illustrates an upmixer according to an embodiment. The upmixer comprises an apparatus for generating a stereo side signal 1510, a first mid channel generator 1520 and a second mid channel generator 1530. A first input channel $X_1(f)$ is fed into the apparatus for generating a stereo side signal 1510 and into the first mid channel generator 1520. Moreover, a second input channel X(f) is fed into the apparatus for generating a stereo side signal 1510 and into the second mid channel generator 1530. Furthermore, the apparatus for generating a stereo side signal 1510 feeds the generated first side channel $S_1(f)$ into the first mid channel generator 1520, and moreover feeds the generated second side channel $S_r(f)$ into the second mid channel generator 1530. The first side channel $S_1(f)$ is outputted as a first upmixer channel generated by the upmixer. The second side channel $S_r(f)$ is outputted as a second upmixer channel generated by the upmixer. The first mid channel generator 1520 combines the first input channel $X_1(f)$ and the generated first side channel $S_1(f)$ to obtain a first channel of a stereo mid signal $M_1(f)$. For example, the mid channel generator 1520 may employ the formula:

$$M_1(f)=X_1(f)-S_1(f).$$

Moreover, the second combination unit combines the second channel $S_r(f)$ of the stereo side signal and the second input channel $X_r(f)$ by the mid channel generator 1530 to obtain a second channel $M_r(f)$ of the stereo mid signal. For example, the second combination unit may employ the formula:

$$M_r(f)=X_r(f)-S_r(f).$$

Figure 16:
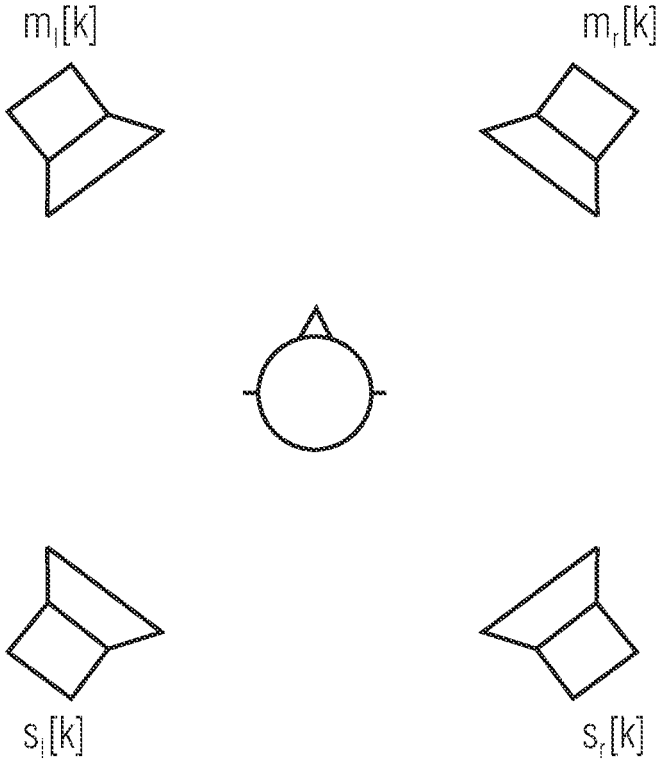
FIG. 16 illustrates an exemplary quadraphonic reproduction system using the outputs of a proposed signal processing.

The first channel of the stereo mid signal $M_1(f)$ and the second channel of the stereo mid signal $M_r(f)$ are outputted as third and fourth upmixer channel, respectively. As can be seen, the existence of a stereo mid signal and a stereo side signal is advantageous for the application of upmixing of a stereo signal for the reproduction using surround sound systems. One possible application of the stereo side and the stereo mid signal is the quadraphonic sound reproduction as shown in FIG. 16. It comprises four channels, which are fed into the stereo mid signals and the stereo side signals.

The exemplary application of quadraphonic reproduction as described above is a good illustration for the characteristics of the stereo side signal and the stereo mid signal. It is noted that the described processing can be extended further for reproducing the audio signal with different formats than quadraphonic. More output channel signals are computed by first separating the stereo side signal and the stereo mid signal, and applying the described processing again to one or both of them. For example, a signal for the reproduction using 5 channels according to ITU-R BS.775 [1] can be derived by repeating the signal decomposition with the stereo mid signal as input signal.

Figure 17:
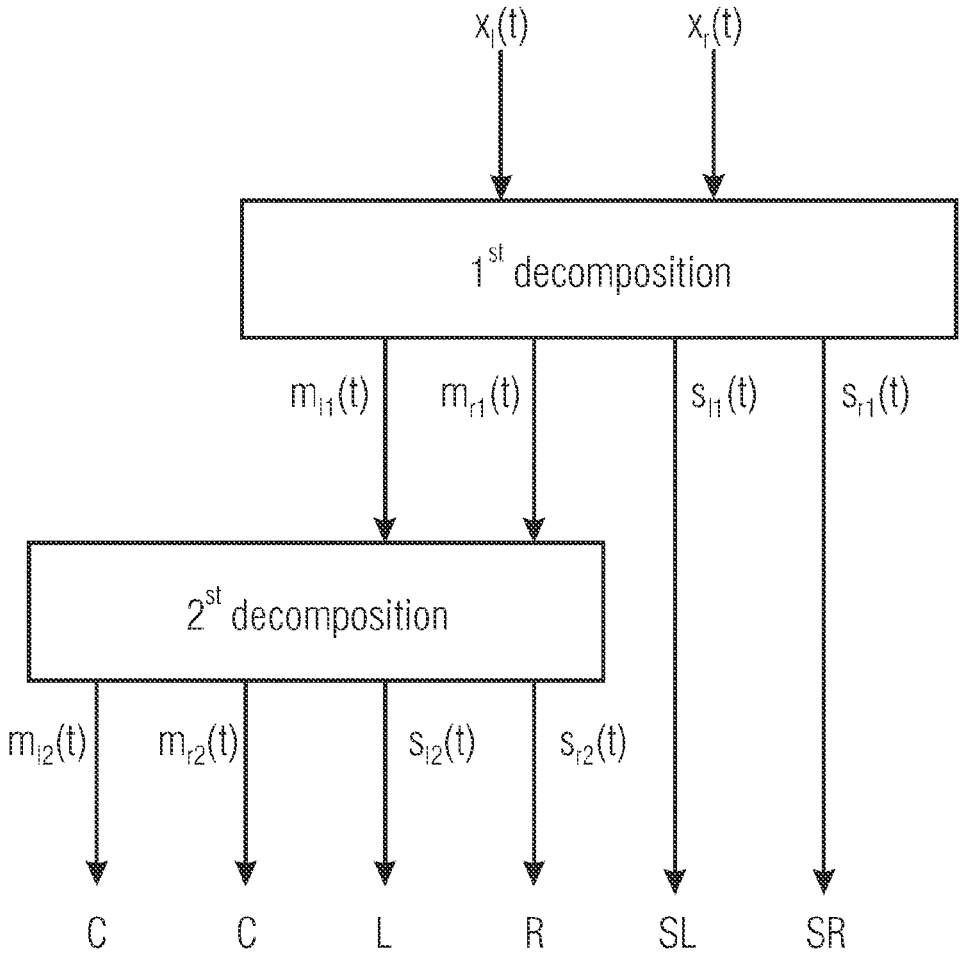
FIG. 17 depicts a block diagram illustrating the processing to generate a multi-channel signal suitable for the reproduction with 5 channels.

FIG. 17 illustrates a block diagram of the processing to generate a multi-channel signal suitable for the reproduction with five channels, with a center C, a left L, a right R, a surround left SL and a surround right SR channel.

The above-described methods and apparatuses have been presented for decomposing a stereo input signal into a stereo side signal and/or a stereo mid signal. Spectral subtraction or spectral weighting is applied for the spectral separation. An MS decomposition yields the direction-based information which is necessitated for computing the degree to which each time-frequency tile contributes to either the stereo side signal and the stereo mid signal. Such signals are used for the application of upmixing of stereo signals for the reproduction by surround sound systems.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for generating a stereo side signal comprising a first side channel and a second side channel from a stereo input signal comprising a first input channel and a second input channel, comprising:

a modification information generator for generating modification information, the modification information generator comprising a spectral weights generator for generating the modification information by generating a first spectral weighting factor using a mono mid signal and using a mono side signal of the stereo input signal, wherein the mono mid signal depends on a sum of the first input channel and the second input channel, and wherein the mono side signal depends on a difference of the first input channel and the second input channel, and a signal manipulator being adapted to manipulate the first input channel using the modification information to acquire the first side channel and being adapted to manipulate the second input channel using the modification information to acquire the second side channel.

2. The apparatus according to claim 1, wherein the signal manipulator is adapted to manipulate the second input channel based on the first spectral weighting factor as modification information to acquire the second side channel.

3. The apparatus according to claim 2, wherein the modification information generator is adapted to generate the modification information based on the mono mid signal of the stereo input signal or on the mono side signal of the stereo input signal, wherein the mono mid signal depends on a sum signal resulting from adding the first and the second input channel, and wherein the mono side signal depends on a difference signal resulting from subtracting the second input channel from the first input channel.

4. The apparatus according to claim 2, wherein the apparatus further comprises a channel generator, wherein the channel generator is adapted to generate the mono mid signal or the mono side signal based on the first and the second input channel.

5. The apparatus according to claim 2, wherein the apparatus further comprises:

a transform unit for transforming the first and the second input channel of the stereo input signal from a time domain into a spectral domain, and an inverse transform unit, wherein the signal manipulator is adapted to manipulate the first input channel being represented in the spectral domain and the second input channel being represented in the spectral domain to acquire the stereo side signal being represented in the spectral domain, and wherein the inverse transform unit is adapted to transform the stereo side signal being represented in the spectral domain from the spectral domain into the time domain.

6. The apparatus according to claim 1, wherein the modification information generator comprises the spectral weights generator for generating the modification information by generating the first spectral weighting factor based on the mono mid signal and on the mono side signal of the stereo input signal, wherein the spectral weights generator is adapted to generate a second spectral weighting factor based on the mono mid signal and on the mono side signal of the stereo input signal, and wherein the signal manipulator is adapted to manipulate the second input channel based on the second spectral weighting factor as modification information to acquire the second side channel.

7. The apparatus according to claim 1, wherein the modification information generator comprises the spectral weights generator for generating the modification information by generating the first spectral weighting factor based on the mono mid signal and on the mono side signal of the stereo input signal, wherein the modification information generator further comprises a magnitude determinator, wherein the magnitude determinator is adapted to receive the mono mid signal being represented in a spectral domain, and wherein the magnitude determinator is adapted to receive the mono side signal being represented in a spectral domain, wherein the magnitude determinator is adapted to determine a magnitude value of the mono side signal as a magnitude side value and wherein the magnitude determinator is adapted to determine a magnitude value of the mono mid signal as a magnitude mid value, wherein the magnitude determinator is adapted to feed the magnitude side value and the magnitude mid value into the spectral weights generator, and wherein the spectral weights generator is adapted to generate the first spectral weighting factor based on a ratio of a first number to a second number, wherein the first number depends on the magnitude side value, and wherein the second number depends on the magnitude mid value and the magnitude side value.

8. The apparatus according to claim 1, wherein the modification information generator comprises the spectral weights generator for generating the modification information by generating the first spectral weighting factor based on the mono mid signal and on the mono side signal of the stereo input signal, wherein the spectral weights generator is adapted to generate the modification factor according to the formula:

$$G_s(f) = \left(\frac{|S(f)|^\alpha}{\delta|S(f)|^\alpha + \gamma|M(f)|^\alpha}\right)^{\frac{1}{\beta}}$$

or, wherein the spectral weights generator is adapted to generate the modification factor according to the formula:

$$G_s(f) = \left(\frac{|S(f)|^\alpha}{\delta|S(f)|^\alpha + \gamma\min[|X_l(f)|, |X_r(f)|]^\alpha}\right)^{\frac{1}{\beta}}$$

or, wherein the spectral weights generator is adapted to generate the modification factor according to the formula:

$$G_s(f) = \left(\frac{|S(f)|^\alpha}{\delta|S(f)|^\alpha + \gamma Q(f)^\alpha}\right)^{\frac{1}{\beta}}$$

with $$Q(f) = \eta\min[|X_l(f)|, |X_r(f)|] + (1-\eta)M(f)$$

wherein |S(f)| indicates a magnitude spectrum of the mono side signal, wherein |M(f)| indicates a magnitude spectrum of the mono mid signal, wherein $|X_{,l}(f)|$ indicates a magnitude spectrum of the first input channel, wherein $|X_r(f)|$ indicates a magnitude spectrum of the second input channel, wherein M(f) indicates the mono mid signal, and wherein α, β, γ, δand η are scalar factors.

9. An upmixer, comprising:

an apparatus for generating a stereo side signal comprising a first side channel and a second side channel according to claim 1, wherein the apparatus is adapted to generate the first side channel as a first upmixer channel, and wherein the apparatus is adapted to generate the second side channel as a second upmixer channel, a first mid channel generator for generating the first mid channel as a third upmixer channel based on a difference between the first stereo input channel and the first side channel, and a second mid channel generator for generating the second mid channel as a fourth upmixer channel based on a difference between the second stereo input channel and the second side channel.

10. An apparatus for generating a stereo mid signal comprising a first mid channel and a second mid channel from a stereo input signal comprising a first input channel and a second input channel, comprising:

a modification information generator for generating modification information, the modification information generator comprising a spectral weights generator for generating the modification information by generating a first spectral weighting factor using a mono mid signal and using a mono side signal of the stereo input signal wherein the mono mid signal depends on a sum of the first input channel and the second input channel, and wherein the mono side signal depends on a difference of the first input channel and the second input channel, and a signal manipulator being adapted to manipulate the first input channel using the modification information to acquire the first mid channel and being adapted to manipulate the second input channel using the modification information to acquire the second mid channel.

11. The apparatus according to claim 10, wherein the modification information generator further comprises a magnitude determinator, wherein the magnitude determinator is adapted to determine a magnitude value of the mono side signal being represented in a spectral domain as a magnitude side value and wherein the magnitude determinator is adapted to determine a magnitude value of the mono mid signal being represented in a spectral domain as a magnitude mid value, wherein the magnitude determinator is adapted to feed the magnitude side value and the magnitude mid value into the spectral weights generator, and wherein the spectral weights generator is adapted to generate the first spectral weighting factor based on a ratio of a first number to a second number, wherein the first number depends on the magnitude side value, and wherein the second number depends on the magnitude mid value and the magnitude side value.

12. A method for generating a stereo side signal comprising a first side channel and a second side channel from a stereo input signal comprising a first input channel and a second input channel, comprising:

generating modification information by generating a first spectral weighting factor using a mono mid signal and using a mono side signal of the stereo input signal, wherein the mono mid signal depends on a sum of the first input channel and the second input channel, and wherein the mono side signal depends on a difference of the first input channel and the second input channel, manipulating the first input channel using the modification information to acquire the first side channel, and manipulating the second input channel using the modification information to acquire the second side channel.

13. A method for generating a stereo mid signal comprising a first mid channel and a second mid channel from a stereo input signal comprising a first input channel and a second input channel, comprising:

generating modification information by generating a first spectral weighting factor using a mono mid signal and using a mono side signal of the stereo input signal, wherein the mono mid signal depends on a sum of the first input channel and the second input channel, and wherein the mono side signal depends on a difference of the first input channel and the second input channel, manipulating the first input channel using the modification information to acquire the first mid channel, and manipulating the second input channel using the modification information to acquire the second mid channel.

14. The method according to claim 13, wherein generating modification information comprises:

generating the modification information by generating a first spectral weighting factor, wherein the first spectral weighting factor depends on a mono mid signal and a mono side signal of the stereo input signal, determining a magnitude value of the mono side signal being represented in a spectral domain as a magnitude side value determining a magnitude value of the mono mid signal being represented in a spectral domain as a magnitude mid value, feeding the magnitude side value and the magnitude mid value into the spectral weights generator, and generating the first spectral weighting factor based on a ratio of a first number to a second number, wherein the first number depends on the magnitude side value, and wherein the second number depends on the magnitude mid value and the magnitude side value.

15. A non-transitory computer readable medium comprising a computer program for implementing the method according to claim 12, executed on a computer or processor.

16. A non-transitory computer readable medium comprising a computer program for implementing the method according to claim 13, executed on a computer or processor.

* * * * *